US010246222B2

(12) United States Patent
Hudachek et al.

(10) Patent No.: US 10,246,222 B2
(45) Date of Patent: Apr. 2, 2019

(54) EXTENDABLE HANDLE ASSEMBLY

(71) Applicant: Susan Francesca Hudachek, Severance, CO (US)

(72) Inventors: Susan Francesca Hudachek, Severance, CO (US); Kevin Willey, Fort Collins, CO (US)

( * ) Notice: Subject to any disclaimer, the term of this patent is extended or adjusted under 35 U.S.C. 154(b) by 0 days.

(21) Appl. No.: 14/908,868

(22) PCT Filed: Aug. 21, 2015

(86) PCT No.: PCT/US2015/046326

§ 371 (c)(1),
(2) Date: Jan. 29, 2016

(87) PCT Pub. No.: WO2016/029134

PCT Pub. Date: Feb. 25, 2016

(65) Prior Publication Data

US 2016/0288958 A1 Oct. 6, 2016

Related U.S. Application Data

(60) Provisional application No. 62/040,461, filed on Aug. 22, 2014.

(51) Int. Cl.
*B65D 25/28* (2006.01)
*B65D 17/00* (2006.01)

(52) U.S. Cl.
CPC ..... *B65D 25/2811* (2013.01); *B65D 17/00* (2013.01); *B65D 25/285* (2013.01); *B65D 2517/0056* (2013.01); *B65D 2525/287* (2013.01)

(58) Field of Classification Search
CPC .. B65D 25/2811; B65D 17/00; B65D 25/285; B65D 2517/0056; B65D 25/2835; B65D 25/2838; B65D 25/2844; B65D 25/2852; B65D 25/2864; B65D 25/2805; B65D 25/2817; B65D 25/282; B65D 25/2832
USPC ..... 220/770, 769, 768, 759, 758, 755, 752, 220/741, 710.5, 696, 318, 213, 212.5, 220/506, 503, 477, 23.88, 23.89, 23.87, 220/502, 527, 505, 740, 253, 254.6, 255, 220/254.3, 225, 525, 524, 254.1, 762,
(Continued)

(56) References Cited

U.S. PATENT DOCUMENTS 2,373,917 A 4/1945 Ross
2,559,190 A 7/1951 Hallstream
(Continued)

FOREIGN PATENT DOCUMENTS

WO WO 02/46051 6/2002
WO WO 2009/089856 7/2009

OTHER PUBLICATIONS

International Search Report (ISR) for corresponding PCT International Patent Application No. PCT/US2015/046326; ISR = 5 total pages.

(Continued)

*Primary Examiner* — Stephen Castellano
(74) *Attorney, Agent, or Firm* — Susan F. Hudachek

(57) ABSTRACT

A handle assembly for grippably engaging a container, and methods for making and using such a handle assembly, whereby the handle assembly is adjustable between a collapsed condition and an extended condition in which the handle assembly provides a grippable element for grippably engaging the container.

10 Claims, 31 Drawing Sheets

(58) Field of Classification Search
USPC ..... 220/763, 764, 766, 754, 757; 16/445, 16/443, 434, 429, 428; 43/55, 56, 57
See application file for complete search history.

(56) References Cited

U.S. PATENT DOCUMENTS

| | | | | | |
|---|---|---|---|---|---|
| 3,692,202 | A | | 9/1972 | Parlagreco | |
| 3,979,011 | A | | 9/1976 | Schleicher | |
| 4,230,235 | A | | 10/1980 | Di Amico | |
| 4,556,245 | A | * | 12/1985 | Gruenwald | A45F 5/10 16/110.1 |
| 4,585,134 | A | | 4/1986 | Miyaji | |
| 4,842,158 | A | | 6/1989 | Reyes | |
| D512,910 | S | * | 12/2005 | Haslam | D9/434 |
| 8,608,019 | B2 | | 12/2013 | Wren | |
| 2010/0282767 | A1 | | 11/2010 | Wren | |

OTHER PUBLICATIONS

Written Opinion (WO) for corresponding PCT International Patent Application No. PCT/US2015/046326; WO = 14 total pages.
Island Dogs, Product 98489, Can Grip—Metal, Website: http://www.islanddogs.com/products/can-grip-metal, originally downloaded Aug. 30, 2013, 2 pages.
The Can Grip, Website: http://www.cangrip.com, originally downloaded Aug. 30, 2013, 1 page.

* cited by examiner

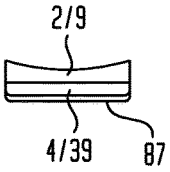
FIG. 13
FIG. 9
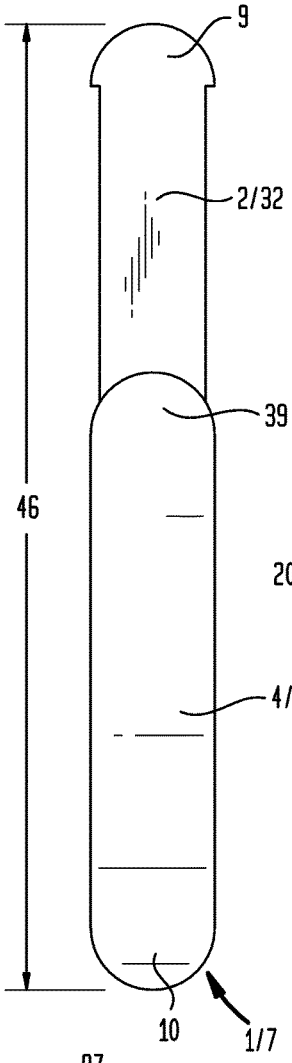
FIG. 10
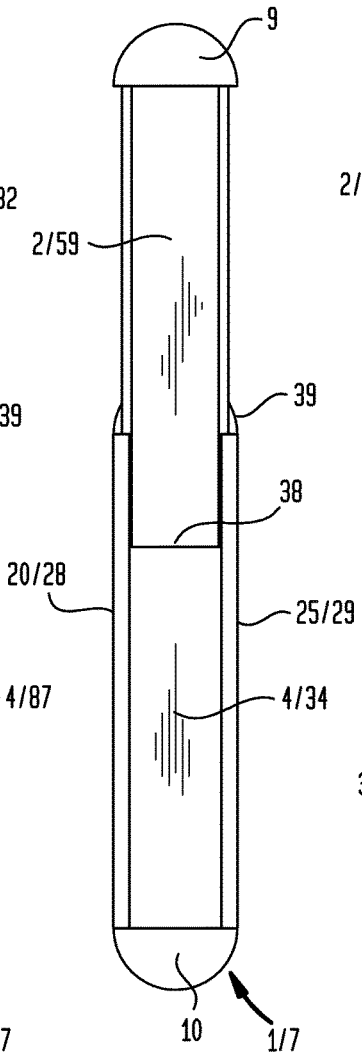
FIG. 11
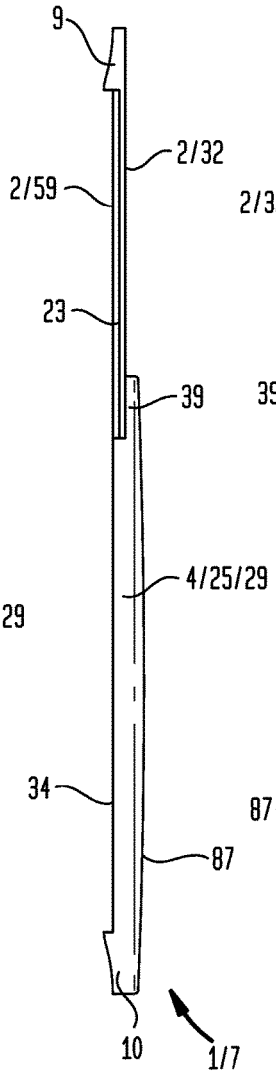
FIG. 12
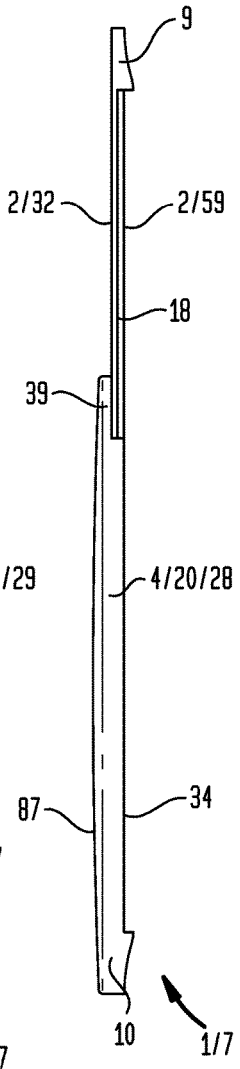
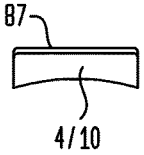
FIG. 14

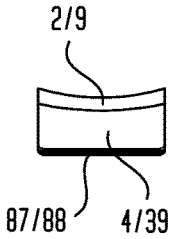
FIG. 35
FIG. 31
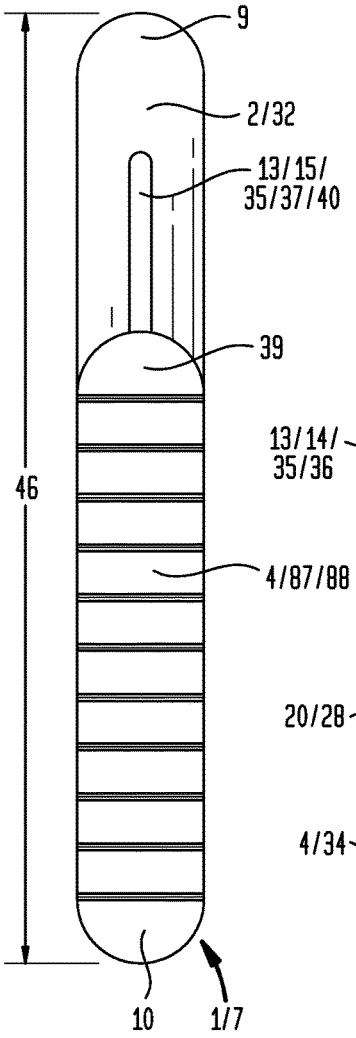
FIG. 32
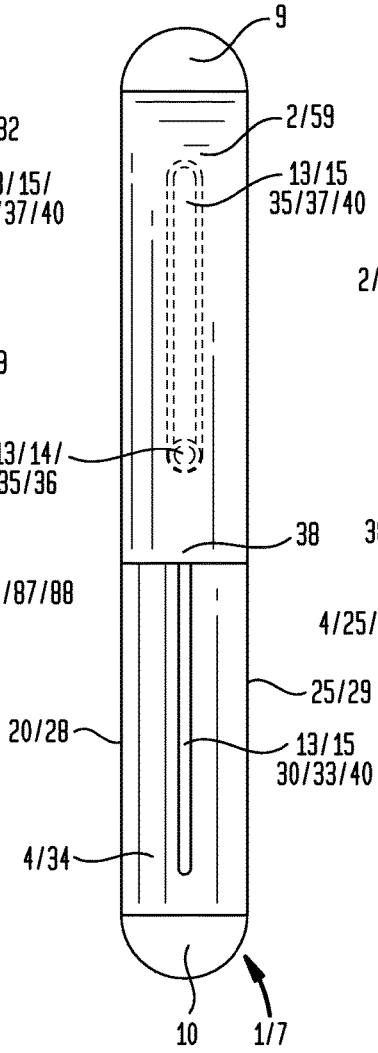
FIG. 33
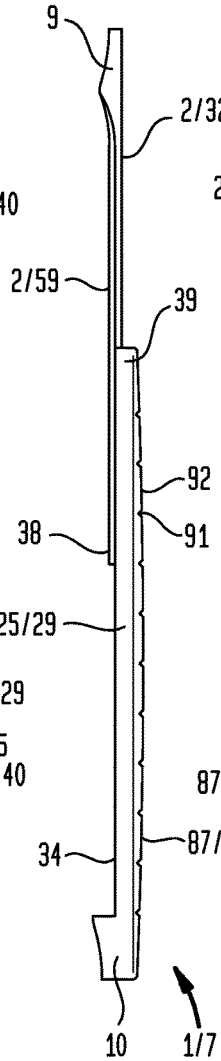
FIG. 34
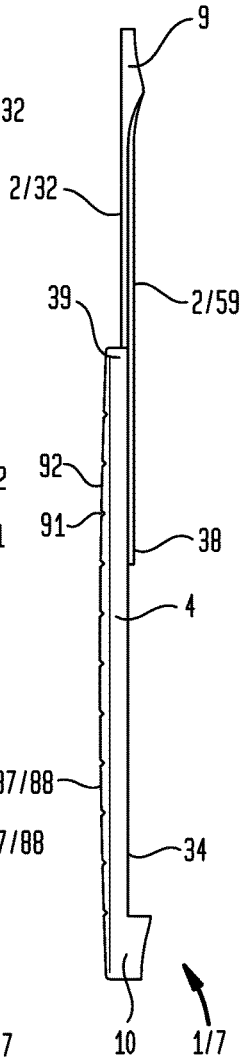
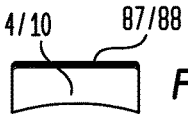
FIG. 36

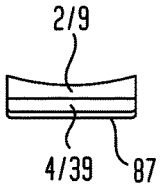
FIG. 57
FIG. 53
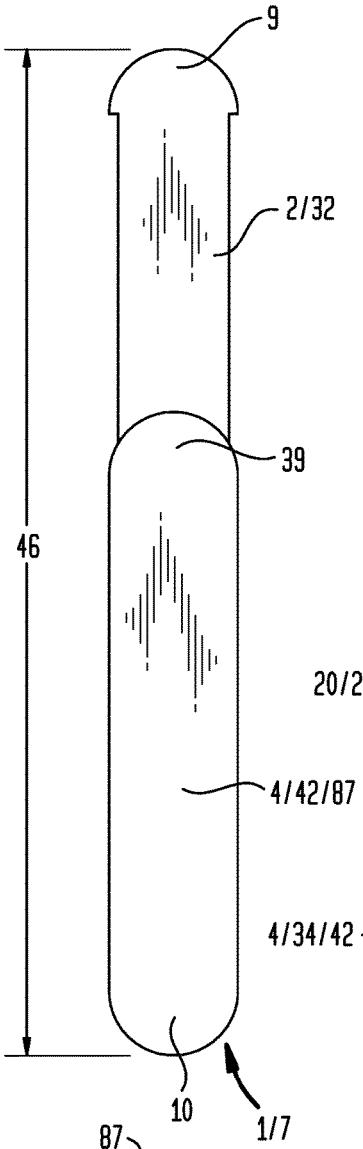
FIG. 54
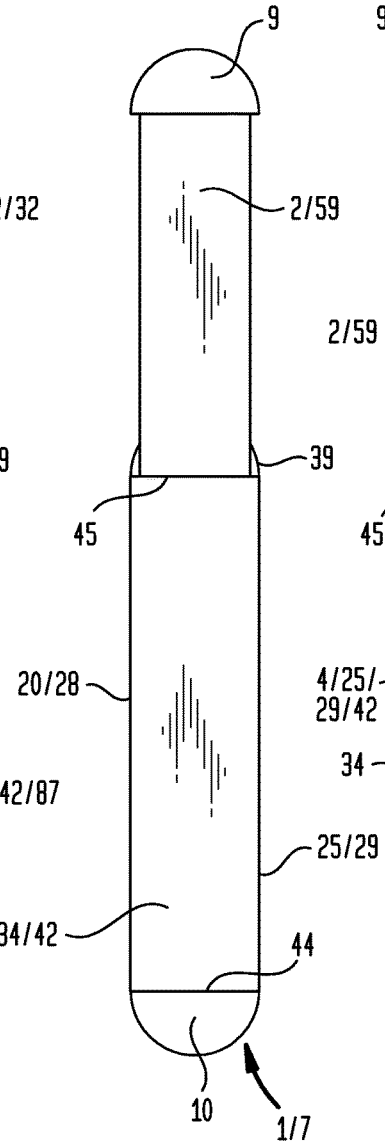
FIG. 55
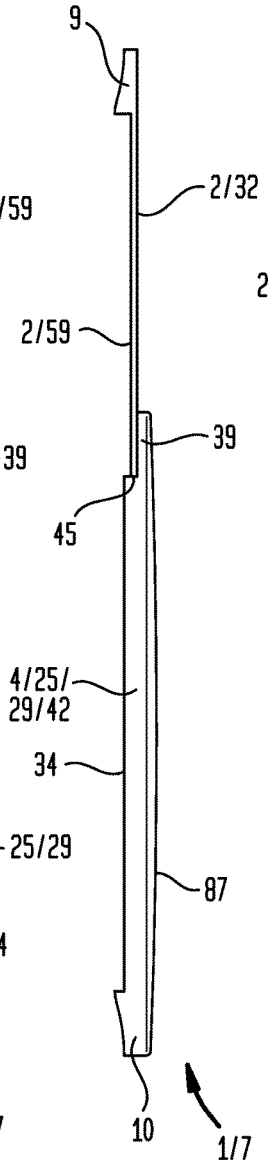
FIG. 56
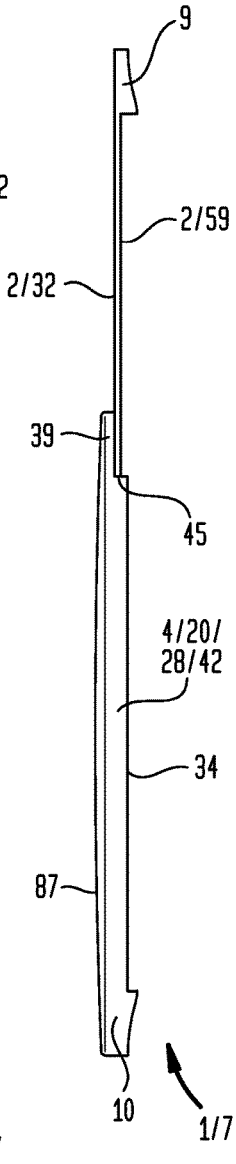
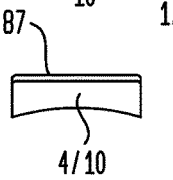
FIG. 58

72/83
66/75
8
71
67/89
76/78
70

72/82
76/78
69/85
66/75
67/89
8
71

72/83
76/78
66/75
69/86
71
67/89
8
76/78
70

EXTENDABLE HANDLE ASSEMBLY

This application is the United States National Stage entry of International Patent Cooperation Treaty Patent Application No. PCT/US15/46326, filed Aug. 21, 2015, which claims the benefit of U.S. Provisional Patent Application No. 62/040,461, filed Aug. 22, 2014, each hereby incorporated by reference herein.

I. TECHNICAL FIELD

Generally, a handle assembly and methods for making and using such a handle assembly. Specifically, a handle assembly for grippably engaging a container, whereby the handle assembly is adjustable between a collapsed condition and an extended condition in which the handle assembly provides a grippable element for grippably engaging the container.

II. BACKGROUND

A need exists for a handle assembly for grippably engaging a container, whereby the handle assembly is adjustable between a collapsed condition and an extended condition in which the handle assembly provides a grippable element for grippably engaging the container.

III. DISCLOSURE OF INVENTION

A broad object of a particular embodiment of the invention can be to provide a handle assembly for coupling to a container, and methods of making and using such a handle assembly. The handle assembly includes a first member having a first member length and a second member having a second member length, whereby the first and second members adjustably overlappingly couple along the first and second member lengths. The handle assembly is adjustable between a collapsed condition, having greater portions of the first and second member lengths overlappingly engaged, and an extended condition, having lesser portions of the first and second member lengths overlappingly engaged.

Another broad object of a particular embodiment of the invention can be to provide a handle assembly for coupling to a container, and methods of making and using such a handle assembly. The handle assembly includes an annular member and an elongate member having an elongate member length disposed between elongate member first and second ends, whereby the elongate member first end pivotally couples to the annular member. The handle assembly is configured to couple to the container by rotatable coupling of the annular member about a container external wall and pivotal coupling of the elongate member second end to the container external wall. The handle assembly coupled to the container is adjustable between a collapsed condition and an extended condition. In the collapsed condition, the elongate member length disposes proximate the container external wall; and in the extended condition, the elongate member length outwardly extends from the container external wall to provide a grippable element for grippably engaging the container.

Naturally, further objects of the invention are disclosed throughout other areas of the specification, drawings, and claims.

IV. BRIEF DESCRIPTION OF THE DRAWINGS

FIG. 1A is an illustration of a method of using a particular embodiment of a handle assembly for grippably engaging a container, the handle assembly including a first member and a second member adjustably overlappingly coupled along first and second member lengths by a first pair of matable elements, including a first protrusion outwardly extending from a first member first side surface and a first recess disposed within a second member first side surface, and a second pair of matable elements, including a second protrusion outwardly extending from a first member second side surface and a second recess disposed within a second member second side surface, whereby the handle assembly disposes in a collapsed condition.

FIG. 1B is an illustration of a method of using a particular embodiment of a handle assembly for grippably engaging a container, the handle assembly including a first member and a second member adjustably overlappingly coupled along first and second member lengths by a first pair of matable elements, including a first protrusion outwardly extending from a first member first side surface and a first recess disposed within a second member first side surface, and a second pair of matable elements, including a second protrusion outwardly extending from a first member second side surface and a second recess disposed within a second member second side surface, whereby the handle assembly disposes in an extended condition to provide a grippable element for grippably engaging the container.

FIG. 2A is a perspective view of a particular embodiment of a handle assembly including a first member and a second member adjustably overlappingly coupled along first and second member lengths by a first pair of matable elements, including a first protrusion outwardly extending from a first member first side surface and a first recess disposed within a second member first side surface, and a second pair of matable elements, including a second protrusion outwardly extending from a first member second side surface and a second recess disposed within a second member second side surface, whereby the handle assembly disposes in a collapsed condition.

FIG. 2B is a perspective view of a particular embodiment of a handle assembly including a first member and a second member adjustably overlappingly coupled along first and second member lengths by a first pair of matable elements, including a first protrusion outwardly extending from a first member first side surface and a first recess disposed within a second member first side surface, and a second pair of matable elements, including a second protrusion outwardly extending from a first member second side surface and a second recess disposed within a second member second side surface, whereby the handle assembly disposes in an extended condition.

FIG. 2C is a perspective view of a particular embodiment of a handle assembly including a first member and a second member adjustably overlappingly coupled along first and second member lengths by a first pair of matable elements, including a first protrusion outwardly extending from a first member first side surface and a first recess disposed within a second member first side surface, and a second pair of matable elements, including a second protrusion outwardly extending from a first member second side surface and a second recess disposed within a second member second side surface, whereby the handle assembly disposes in an extended condition.

FIG. 3 is a front view of a particular embodiment of a handle assembly including a first member and a second member adjustably overlappingly coupled along first and second member lengths by a first pair of matable elements, including a first protrusion outwardly extending from a first member first side surface and a first recess disposed within a second member first side surface, and a second pair of matable elements, including a second protrusion outwardly extending from a first member second side surface and a second recess disposed within a second member second side surface, whereby the handle assembly disposes in a collapsed condition.

FIG. 4 is a back view of a particular embodiment of a handle assembly including a first member and a second member adjustably overlappingly coupled along first and second member lengths by a first pair of matable elements, including a first protrusion outwardly extending from a first member first side surface and a first recess disposed within a second member first side surface, and a second pair of matable elements, including a second protrusion outwardly extending from a first member second side surface and a second recess disposed within a second member second side surface, whereby the handle assembly disposes in a collapsed condition.

FIG. 5 is a second side view of a particular embodiment of a handle assembly including a first member and a second member adjustably overlappingly coupled along first and second member lengths by a first pair of matable elements, including a first protrusion outwardly extending from a first member first side surface and a first recess disposed within a second member first side surface, and a second pair of matable elements, including a second protrusion outwardly extending from a first member second side surface and a second recess disposed within a second member second side surface, whereby the handle assembly disposes in a collapsed condition.

FIG. 6 is a first side view of a particular embodiment of a handle assembly including a first member and a second member adjustably overlappingly coupled along first and second member lengths by a first pair of matable elements, including a first protrusion outwardly extending from a first member first side surface and a first recess disposed within a second member first side surface, and a second pair of matable elements, including a second protrusion outwardly extending from a first member second side surface and a second recess disposed within a second member second side surface, whereby the handle assembly disposes in a collapsed condition.

FIG. 7 is a first end view of a particular embodiment of a handle assembly including a first member and a second member adjustably overlappingly coupled along first and second member lengths by a first pair of matable elements, including a first protrusion outwardly extending from a first member first side surface and a first recess disposed within a second member first side surface, and a second pair of matable elements, including a second protrusion outwardly extending from a first member second side surface and a second recess disposed within a second member second side surface, whereby the handle assembly disposes in a collapsed condition.

FIG. 8 is a second end view of a particular embodiment of a handle assembly including a first member and a second member adjustably overlappingly coupled along first and second member lengths by a first pair of matable elements, including a first protrusion outwardly extending from a first member first side surface and a first recess disposed within a second member first side surface, and a second pair of matable elements, including a second protrusion outwardly extending from a first member second side surface and a second recess disposed within a second member second side surface, whereby the handle assembly disposes in a collapsed condition.

FIG. 9 is a front view of a particular embodiment of a handle assembly including a first member and a second member adjustably overlappingly coupled along first and second member lengths by a first pair of matable elements, including a first protrusion outwardly extending from a first member first side surface and a first recess disposed within a second member first side surface, and a second pair of matable elements, including a second protrusion outwardly extending from a first member second side surface and a second recess disposed within a second member second side surface, whereby the handle assembly disposes in an extended condition.

FIG. 10 is a back view of a particular embodiment of a handle assembly including a first member and a second member adjustably overlappingly coupled along first and second member lengths by a first pair of matable elements, including a first protrusion outwardly extending from a first member first side surface and a first recess disposed within a second member first side surface, and a second pair of matable elements, including a second protrusion outwardly extending from a first member second side surface and a second recess disposed within a second member second side surface, whereby the handle assembly disposes in an extended condition.

FIG. 11 is a second side view of a particular embodiment of a handle assembly including a first member and a second member adjustably overlappingly coupled along first and second member lengths by a first pair of matable elements, including a first protrusion outwardly extending from a first member first side surface and a first recess disposed within a second member first side surface, and a second pair of matable elements, including a second protrusion outwardly extending from a first member second side surface and a second recess disposed within a second member second side surface, whereby the handle assembly disposes in an extended condition.

FIG. 12 is a first side view of a particular embodiment of a handle assembly including a first member and a second member adjustably overlappingly coupled along first and second member lengths by a first pair of matable elements, including a first protrusion outwardly extending from a first member first side surface and a first recess disposed within a second member first side surface, and a second pair of matable elements, including a second protrusion outwardly extending from a first member second side surface and a second recess disposed within a second member second side surface, whereby the handle assembly disposes in an extended condition.

FIG. 13 is a first end view of a particular embodiment of a handle assembly including a first member and a second member adjustably overlappingly coupled along first and second member lengths by a first pair of matable elements, including a first protrusion outwardly extending from a first member first side surface and a first recess disposed within a second member first side surface, and a second pair of matable elements, including a second protrusion outwardly extending from a first member second side surface and a second recess disposed within a second member second side surface, whereby the handle assembly disposes in an extended condition.

FIG. 14 is a second end view of a particular embodiment of a handle assembly including a first member and a second member adjustably overlappingly coupled along first and second member lengths by a first pair of matable elements, including a first protrusion outwardly extending from a first member first side surface and a first recess disposed within a second member first side surface, and a second pair of matable elements, including a second protrusion outwardly extending from a first member second side surface and a second recess disposed within a second member second side surface, whereby the handle assembly disposes in an extended condition.

FIG. 15 is an exploded perspective view of a particular embodiment of a handle assembly including a first member and a second member adjustably overlappingly coupled along first and second member lengths by a first pair of matable elements, including a first protrusion outwardly extending from a first member first side surface and a first recess disposed within a second member first side surface, and a second pair of matable elements, including a second protrusion outwardly extending from a first member second side surface and a second recess disposed within a second member second side surface.

FIG. 16 is an exploded front view of a particular embodiment of a handle assembly including a first member and a second member adjustably overlappingly coupled along first and second member lengths by a first pair of matable elements, including a first protrusion outwardly extending from a first member first side surface and a first recess disposed within a second member first side surface, and a second pair of matable elements, including a second protrusion outwardly extending from a first member second side surface and a second recess disposed within a second member second side surface.

FIG. 17 is an exploded back view of a particular embodiment of a handle assembly including a first member and a second member adjustably overlappingly coupled along first and second member lengths by a first pair of matable elements, including a first protrusion outwardly extending from a first member first side surface and a first recess disposed within a second member first side surface, and a second pair of matable elements, including a second protrusion outwardly extending from a first member second side surface and a second recess disposed within a second member second side surface.

FIG. 18 is an exploded second side view of a particular embodiment of a handle assembly including a first member and a second member adjustably overlappingly coupled along first and second member lengths by a first pair of matable elements, including a first protrusion outwardly extending from a first member first side surface and a first recess disposed within a second member first side surface, and a second pair of matable elements, including a second protrusion outwardly extending from a first member second side surface and a second recess disposed within a second member second side surface.

FIG. 19 is an exploded first side view of a particular embodiment of a handle assembly including a first member and a second member adjustably overlappingly coupled along first and second member lengths by a first pair of matable elements, including a first protrusion outwardly extending from a first member first side surface and a first recess disposed within a second member first side surface, and a second pair of matable elements, including a second protrusion outwardly extending from a first member second side surface and a second recess disposed within a second member second side surface.

FIG. 20A is a first end view of a particular embodiment of a first member included in handle assembly having a first member and a second member adjustably overlappingly coupled along first and second member lengths by a first pair of matable elements, including a first protrusion outwardly extending from a first member first side surface and a first recess disposed within a second member first side surface, and a second pair of matable elements, including a second protrusion outwardly extending from a first member second side surface and a second recess disposed within a second member second side surface.

FIG. 20B is a second end view of a particular embodiment of a first member included in handle assembly having a first member and a second member adjustably overlappingly coupled along first and second member lengths by a first pair of matable elements, including a first protrusion outwardly extending from a first member first side surface and a first recess disposed within a second member first side surface, and a second pair of matable elements, including a second protrusion outwardly extending from a first member second side surface and a second recess disposed within a second member second side surface.

FIG. 21A is a first end view of a particular embodiment of a second member included in handle assembly having a first member and a second member adjustably overlappingly coupled along first and second member lengths by a first pair of matable elements, including a first protrusion outwardly extending from a first member first side surface and a first recess disposed within a second member first side surface, and a second pair of matable elements, including a second protrusion outwardly extending from a first member second side surface and a second recess disposed within a second member second side surface.

FIG. 21B is a second end view of a particular embodiment of a second member included in handle assembly having a first member and a second member adjustably overlappingly coupled along first and second member lengths by a first pair of matable elements, including a first protrusion outwardly extending from a first member first side surface and a first recess disposed within a second member first side surface, and a second pair of matable elements, including a second protrusion outwardly extending from a first member second side surface and a second recess disposed within a second member second side surface.

FIG. 22A is a second side view of a particular embodiment of a handle assembly including a first member and a second member adjustably overlappingly coupled along first and second member lengths by a first pair of matable elements, including a first protrusion outwardly extending from a first member first side surface and a first recess disposed within a second member first side surface, and a second pair of matable elements, including a second protrusion outwardly extending from a first member second side surface and a second recess disposed within a second member second side surface, whereby the handle assembly disposes in a collapsed condition.

FIG. 22B is a second side view of a particular embodiment of a handle assembly including a first member and a second member adjustably overlappingly coupled along first and second member lengths by a first pair of matable elements, including a first protrusion outwardly extending from a first member first side surface and a first recess disposed within a second member first side surface, and a second pair of matable elements, including a second protrusion outwardly extending from a first member second side surface and a second recess disposed within a second member second side surface, whereby the handle assembly disposes in an extended condition.

FIG. 22C is a second side view of a particular embodiment of a handle assembly including a first member and a second member adjustably overlappingly coupled along first and second member lengths by a first pair of matable elements, including a first protrusion outwardly extending from a first member first side surface and a first recess disposed within a second member first side surface, and a second pair of matable elements, including a second protrusion outwardly extending from a first member second side surface and a second recess disposed within a second member second side surface, whereby the handle assembly disposes in an extended condition to provide a grippable element for grippably engaging the container.

FIG. 22D is a perspective view of a particular embodiment of a handle assembly including a first member and a second member adjustably overlappingly coupled along first and second member lengths by a first pair of matable elements, including a first protrusion outwardly extending from a first member first side surface and a first recess disposed within a second member first side surface, and a second pair of matable elements, including a second protrusion outwardly extending from a first member second side surface and a second recess disposed within a second member second side surface, whereby the handle assembly disposes in an extended condition to provide a grippable element for grippably engaging the container.

FIG. 22E is an exploded second side view of a particular embodiment of a handle assembly including a first member and a second member adjustably overlappingly coupled along first and second member lengths by a first pair of matable elements, including a first protrusion outwardly extending from a first member first side surface and a first recess disposed within a second member first side surface, and a second pair of matable elements, including a second protrusion outwardly extending from a first member second side surface and a second recess disposed within a second member second side surface, whereby the handle assembly disposes in an extended condition to provide a grippable element for grippably engaging the container.

FIG. 23A is an illustration of a method of using a particular embodiment of a handle assembly for grippably engaging a container, the handle assembly including a first member and a second member adjustably overlappingly coupled along first and second member lengths by a third pair of matable elements, including a third protrusion outwardly extending from a first member front surface and a third recess disposed within a second member back surface, and a fourth pair of matable elements, including a fourth protrusion outwardly extending from a second member back surface and a fourth recess disposed within a first member front surface, whereby the handle assembly disposes in a collapsed condition.

FIG. 23B is an illustration of a method of using a particular embodiment of a handle assembly for grippably engaging a container, the handle assembly including a first member and a second member adjustably overlappingly coupled along first and second member lengths by a third pair of matable elements, including a third protrusion outwardly extending from a first member front surface and a third recess disposed within a second member back surface, and a fourth pair of matable elements, including a fourth protrusion outwardly extending from a second member back surface and a fourth recess disposed within a first member front surface, whereby the handle assembly disposes in an extended condition to provide a grippable element for grippably engaging the container.

FIG. 24A is a perspective view of a particular embodiment of a handle assembly including a first member and a second member adjustably overlappingly coupled along first and second member lengths by a third pair of matable elements, including a third protrusion outwardly extending from a first member front surface and a third recess disposed within a second member back surface, and a fourth pair of matable elements, including a fourth protrusion outwardly extending from a second member back surface and a fourth recess disposed within a first member front surface, whereby the handle assembly disposes in a collapsed condition.

FIG. 24B is a perspective view of a particular embodiment of a handle assembly including a first member and a second member adjustably overlappingly coupled along first and second member lengths by a third pair of matable elements, including a third protrusion outwardly extending from a first member front surface and a third recess disposed within a second member back surface, and a fourth pair of matable elements, including a fourth protrusion outwardly extending from a second member back surface and a fourth recess disposed within a first member front surface, whereby the handle assembly disposes in an extended condition.

FIG. 24C is a perspective view of a particular embodiment of a handle assembly including a first member and a second member adjustably overlappingly coupled along first and second member lengths by a third pair of matable elements, including a third protrusion outwardly extending from a first member front surface and a third recess disposed within a second member back surface, and a fourth pair of matable elements, including a fourth protrusion outwardly extending from a second member back surface and a fourth recess disposed within a first member front surface, whereby the handle assembly disposes in an extended condition.

FIG. 25 is a front view of a particular embodiment of a handle assembly including a first member and a second member adjustably overlappingly coupled along first and second member lengths by a third pair of matable elements, including a third protrusion outwardly extending from a first member front surface and a third recess disposed within a second member back surface, and a fourth pair of matable elements, including a fourth protrusion outwardly extending from a second member back surface and a fourth recess disposed within a first member front surface, whereby the handle assembly disposes in a collapsed condition.

FIG. 26 is a back view of a particular embodiment of a handle assembly including a first member and a second member adjustably overlappingly coupled along first and second member lengths by a third pair of matable elements, including a third protrusion outwardly extending from a first member front surface and a third recess disposed within a second member back surface, and a fourth pair of matable elements, including a fourth protrusion outwardly extending from a second member back surface and a fourth recess disposed within a first member front surface, whereby the handle assembly disposes in a collapsed condition.

FIG. 27 is a second side view of a particular embodiment of a handle assembly including a first member and a second member adjustably overlappingly coupled along first and second member lengths by a third pair of matable elements, including a third protrusion outwardly extending from a first member front surface and a third recess disposed within a second member back surface, and a fourth pair of matable elements, including a fourth protrusion outwardly extending from a second member back surface and a fourth recess disposed within a first member front surface, whereby the handle assembly disposes in a collapsed condition.

FIG. 28 is a first side view of a particular embodiment of a handle assembly including a first member and a second member adjustably overlappingly coupled along first and second member lengths by a third pair of matable elements, including a third protrusion outwardly extending from a first member front surface and a third recess disposed within a second member back surface, and a fourth pair of matable elements, including a fourth protrusion outwardly extending from a second member back surface and a fourth recess disposed within a first member front surface, whereby the handle assembly disposes in a collapsed condition.

FIG. 29 is a first end view of a particular embodiment of a handle assembly including a first member and a second member adjustably overlappingly coupled along first and second member lengths by a third pair of matable elements, including a third protrusion outwardly extending from a first member front surface and a third recess disposed within a second member back surface, and a fourth pair of matable elements, including a fourth protrusion outwardly extending from a second member back surface and a fourth recess disposed within a first member front surface, whereby the handle assembly disposes in a collapsed condition.

FIG. 30 is a second end view of a particular embodiment of a handle assembly including a first member and a second member adjustably overlappingly coupled along first and second member lengths by a third pair of matable elements, including a third protrusion outwardly extending from a first member front surface and a third recess disposed within a second member back surface, and a fourth pair of matable elements, including a fourth protrusion outwardly extending from a second member back surface and a fourth recess disposed within a first member front surface, whereby the handle assembly disposes in a collapsed condition.

FIG. 31 is a front view of a particular embodiment of a handle assembly including a first member and a second member adjustably overlappingly coupled along first and second member lengths by a third pair of matable elements, including a third protrusion outwardly extending from a first member front surface and a third recess disposed within a second member back surface, and a fourth pair of matable elements, including a fourth protrusion outwardly extending from a second member back surface and a fourth recess disposed within a first member front surface, whereby the handle assembly disposes in an extended condition.

FIG. 32 is a back view of a particular embodiment of a handle assembly including a first member and a second member adjustably overlappingly coupled along first and second member lengths by a third pair of matable elements, including a third protrusion outwardly extending from a first member front surface and a third recess disposed within a second member back surface, and a fourth pair of matable elements, including a fourth protrusion outwardly extending from a second member back surface and a fourth recess disposed within a first member front surface, whereby the handle assembly disposes in an extended condition.

FIG. 33 is a second side view of a particular embodiment of a handle assembly including a first member and a second member adjustably overlappingly coupled along first and second member lengths by a third pair of matable elements, including a third protrusion outwardly extending from a first member front surface and a third recess disposed within a second member back surface, and a fourth pair of matable elements, including a fourth protrusion outwardly extending from a second member back surface and a fourth recess disposed within a first member front surface, whereby the handle assembly disposes in an extended condition.

FIG. 34 is a first side view of a particular embodiment of a handle assembly including a first member and a second member adjustably overlappingly coupled along first and second member lengths by a third pair of matable elements, including a third protrusion outwardly extending from a first member front surface and a third recess disposed within a second member back surface, and a fourth pair of matable elements, including a fourth protrusion outwardly extending from a second member back surface and a fourth recess disposed within a first member front surface, whereby the handle assembly disposes in an extended condition.

FIG. 35 is a first end view of a particular embodiment of a handle assembly including a first member and a second member adjustably overlappingly coupled along first and second member lengths by a third pair of matable elements, including a third protrusion outwardly extending from a first member front surface and a third recess disposed within a second member back surface, and a fourth pair of matable elements, including a fourth protrusion outwardly extending from a second member back surface and a fourth recess disposed within a first member front surface, whereby the handle assembly disposes in an extended condition.

FIG. 36 is a second end view of a particular embodiment of a handle assembly including a first member and a second member adjustably overlappingly coupled along first and second member lengths by a third pair of matable elements, including a third protrusion outwardly extending from a first member front surface and a third recess disposed within a second member back surface, and a fourth pair of matable elements, including a fourth protrusion outwardly extending from a second member back surface and a fourth recess disposed within a first member front surface, whereby the handle assembly disposes in an extended condition.

FIG. 37 is an exploded perspective view of a particular embodiment of a handle assembly including a first member and a second member adjustably overlappingly coupled along first and second member lengths by a third pair of matable elements, including a third protrusion outwardly extending from a first member front surface and a third recess disposed within a second member back surface, and a fourth pair of matable elements, including a fourth protrusion outwardly extending from a second member back surface and a fourth recess disposed within a first member front surface.

FIG. 38 is an exploded front view of a particular embodiment of a handle assembly including a first member and a second member adjustably overlappingly coupled along first and second member lengths by a third pair of matable elements, including a third protrusion outwardly extending from a first member front surface and a third recess disposed within a second member back surface, and a fourth pair of matable elements, including a fourth protrusion outwardly extending from a second member back surface and a fourth recess disposed within a first member front surface.

FIG. 39 is an exploded back view of a particular embodiment of a handle assembly including a first member and a second member adjustably overlappingly coupled along first and second member lengths by a third pair of matable elements, including a third protrusion outwardly extending from a first member front surface and a third recess disposed within a second member back surface, and a fourth pair of matable elements, including a fourth protrusion outwardly extending from a second member back surface and a fourth recess disposed within a first member front surface.

FIG. 40 is an exploded second side view of a particular embodiment of a handle assembly including a first member and a second member adjustably overlappingly coupled along first and second member lengths by a third pair of matable elements, including a third protrusion outwardly extending from a first member front surface and a third recess disposed within a second member back surface, and a fourth pair of matable elements, including a fourth protrusion outwardly extending from a second member back surface and a fourth recess disposed within a first member front surface.

FIG. 41 is an exploded first side view of a particular embodiment of a handle assembly including a first member and a second member adjustably overlappingly coupled along first and second member lengths by a third pair of matable elements, including a third protrusion outwardly extending from a first member front surface and a third recess disposed within a second member back surface, and a fourth pair of matable elements, including a fourth protrusion outwardly extending from a second member back surface and a fourth recess disposed within a first member front surface.

FIG. 42A is a first end view of a particular embodiment of a first member included in handle assembly having a first member and a second member adjustably overlappingly coupled along first and second member lengths by a third pair of matable elements, including a third protrusion outwardly extending from a first member front surface and a third recess disposed within a second member back surface, and a fourth pair of matable elements, including a fourth protrusion outwardly extending from a second member back surface and a fourth recess disposed within a first member front surface.

FIG. 42B is a second end view of a particular embodiment of a first member included in handle assembly having a first member and a second member adjustably overlappingly coupled along first and second member lengths by a third pair of matable elements, including a third protrusion outwardly extending from a first member front surface and a third recess disposed within a second member back surface, and a fourth pair of matable elements, including a fourth protrusion outwardly extending from a second member back surface and a fourth recess disposed within a first member front surface.

FIG. 43A is a first end view of a particular embodiment of a second member included in handle assembly having a first member and a second member adjustably overlappingly coupled along first and second member lengths by a third pair of matable elements, including a third protrusion outwardly extending from a first member front surface and a third recess disposed within a second member back surface, and a fourth pair of matable elements, including a fourth protrusion outwardly extending from a second member back surface and a fourth recess disposed within a first member front surface.

FIG. 43B is a second end view of a particular embodiment of a second member included in handle assembly having a first member and a second member adjustably overlappingly coupled along first and second member lengths by a third pair of matable elements, including a third protrusion outwardly extending from a first member front surface and a third recess disposed within a second member back surface, and a fourth pair of matable elements, including a fourth protrusion outwardly extending from a second member back surface and a fourth recess disposed within a first member front surface.

FIG. 44A is a second side view of a particular embodiment of a handle assembly including a first member and a second member adjustably overlappingly coupled along first and second member lengths by a third pair of matable elements, including a third protrusion outwardly extending from a first member front surface and a third recess disposed within a second member back surface, and a fourth pair of matable elements, including a fourth protrusion outwardly extending from a second member back surface and a fourth recess disposed within a first member front surface, whereby the handle assembly disposes in a collapsed condition.

FIG. 44B is a second side view of a particular embodiment of a handle assembly including a first member and a second member adjustably overlappingly coupled along first and second member lengths by a third pair of matable elements, including a third protrusion outwardly extending from a first member front surface and a third recess disposed within a second member back surface, and a fourth pair of matable elements, including a fourth protrusion outwardly extending from a second member back surface and a fourth recess disposed within a first member front surface, whereby the handle assembly disposes in an extended condition.

FIG. 44C is a second side view of a particular embodiment of a handle assembly including a first member and a second member adjustably overlappingly coupled along first and second member lengths by a third pair of matable elements, including a third protrusion outwardly extending from a first member front surface and a third recess disposed within a second member back surface, and a fourth pair of matable elements, including a fourth protrusion outwardly extending from a second member back surface and a fourth recess disposed within a first member front surface, whereby the handle assembly disposes in an extended condition to provide a grippable element for grippably engaging the container.

FIG. 44D is a perspective view of a particular embodiment of a handle assembly including a first member and a second member adjustably overlappingly coupled along first and second member lengths by a third pair of matable elements, including a third protrusion outwardly extending from a first member front surface and a third recess disposed within a second member back surface, and a fourth pair of matable elements, including a fourth protrusion outwardly extending from a second member back surface and a fourth recess disposed within a first member front surface, whereby the handle assembly disposes in an extended condition to provide a grippable element for grippably engaging the container.

FIG. 44E is an exploded second side view of a particular embodiment of a handle assembly including a first member and a second member adjustably overlappingly coupled along first and second member lengths by a third pair of matable elements, including a third protrusion outwardly extending from a first member front surface and a third recess disposed within a second member back surface, and a fourth pair of matable elements, including a fourth protrusion outwardly extending from a second member back surface and a fourth recess disposed within a first member front surface, whereby the handle assembly disposes in an extended condition to provide a grippable element for grippably engaging the container.

FIG. 45A is an illustration of a method of using a particular embodiment of a handle assembly for grippably engaging a container, the handle assembly including a first member and a second member adjustably overlappingly coupled along first and second member lengths by telescoping engagement, whereby the handle assembly disposes in a collapsed condition.

FIG. 45B is an illustration of a method of using a particular embodiment of a handle assembly for grippably engaging a container, the handle assembly including a first member and a second member adjustably overlappingly coupled along first and second member lengths by telescoping engagement, whereby the handle assembly disposes in an extended condition to provide a grippable element for grippably engaging the container.

FIG. 53 is a front view of a particular embodiment of a handle assembly including a first member and a second member adjustably overlappingly coupled along first and second member lengths by telescoping engagement, whereby the handle assembly disposes in an extended condition.

FIG. 54 is a back view of a particular embodiment of a handle assembly including a first member and a second member adjustably overlappingly coupled along first and second member lengths by telescoping engagement, whereby the handle assembly disposes in an extended condition.

FIG. 55 is a second side view of a particular embodiment of a handle assembly including a first member and a second member adjustably overlappingly coupled along first and second member lengths by telescoping engagement, whereby the handle assembly disposes in an extended condition.

FIG. 56 is a first side view of a particular embodiment of a handle assembly including a first member and a second member adjustably overlappingly coupled along first and second member lengths by telescoping engagement, whereby the handle assembly disposes in an extended condition.

FIG. 57 is a first end view of a particular embodiment of a handle assembly including a first member and a second member adjustably overlappingly coupled along first and second member lengths by telescoping engagement, whereby the handle assembly disposes in an extended condition.

FIG. 58 is a second end view of a particular embodiment of a handle assembly including a first member and a second member adjustably overlappingly coupled along first and second member lengths by telescoping engagement, whereby the handle assembly disposes in an extended condition.

V. MODE(S) FOR CARRYING OUT THE INVENTION

Figure 1B:
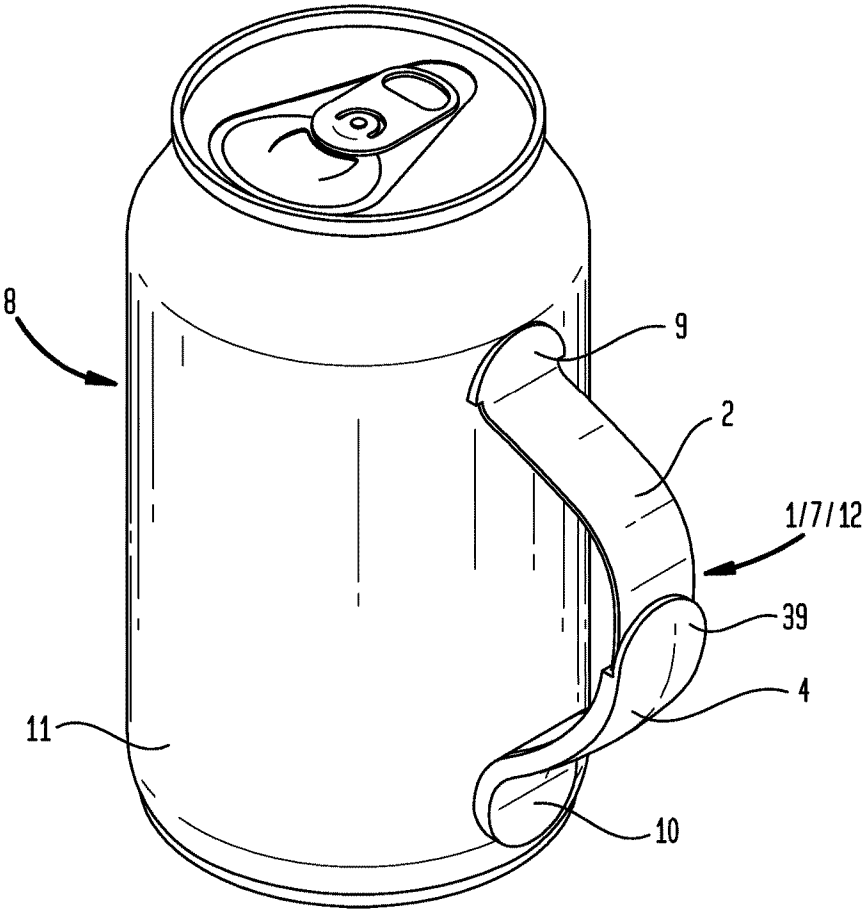

Now referring primarily to FIG. 1A, FIG. 1B, FIG. 23A, FIG. 23B, FIG. 45A, and FIG. 45B, which illustrate methods of using particular embodiments of a handle assembly (1) including a first member (2) having a first member length (3) and a second member (4) having a second member length (5), whereby the first and second members (2)(4) adjustably overlappingly couple along the first and second member lengths (3)(5). The handle assembly (1) can be configured to adjust between a collapsed condition (6), having greater portions of the first and second member lengths (3)(5) overlappingly engaged, and an extended condition (7), having lesser portions of the first and second member lengths (3)(5) overlappingly engaged. The method of using the handle assembly (1) for grippably engaging a container (8), whereby the handle assembly (1) is coupled to the container (8) by coupling of first and second member first ends (9)(10) to a container wall (11), can include adjusting the handle assembly (1) between the collapsed condition (6), in which the first and second member lengths (3)(5) dispose proximate the container wall (11), and the extended condition (7) by outwardly extending the first and second member lengths (3)(5) away from the container wall (11), thereby providing a grippable element (12) for grippably engaging the container (8).

Figure 1A:
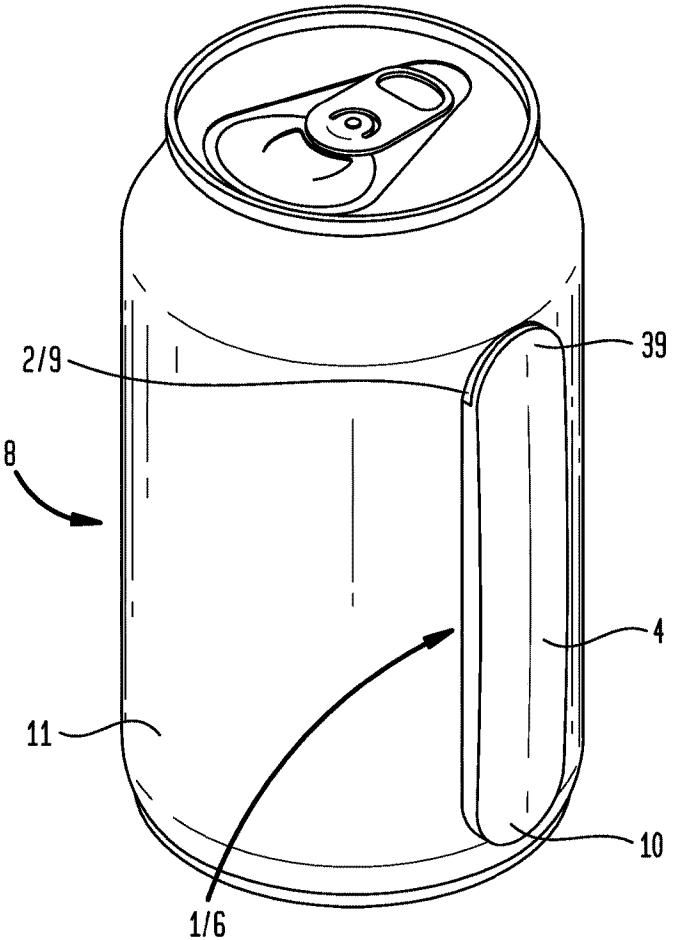
Figure 2C:
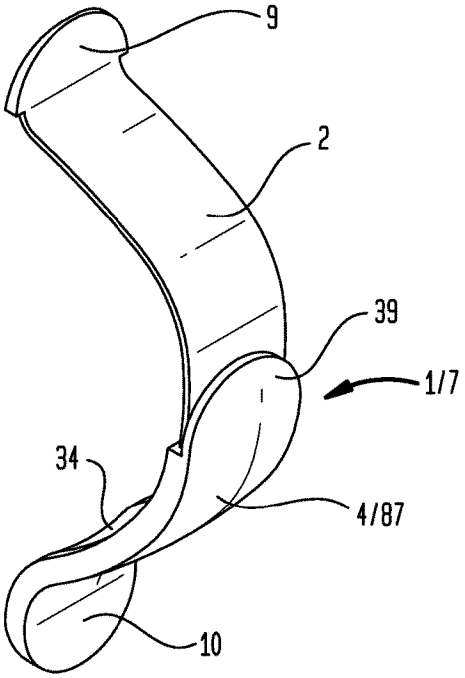
Figure 2B:
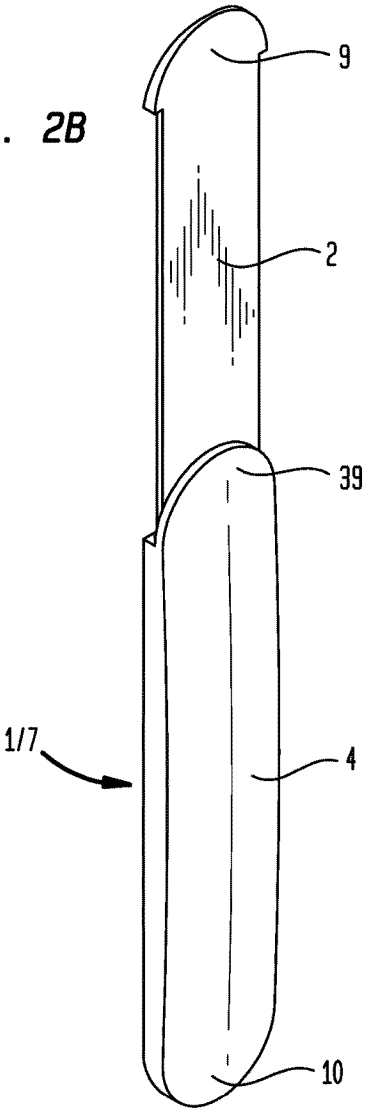
Figure 2A:
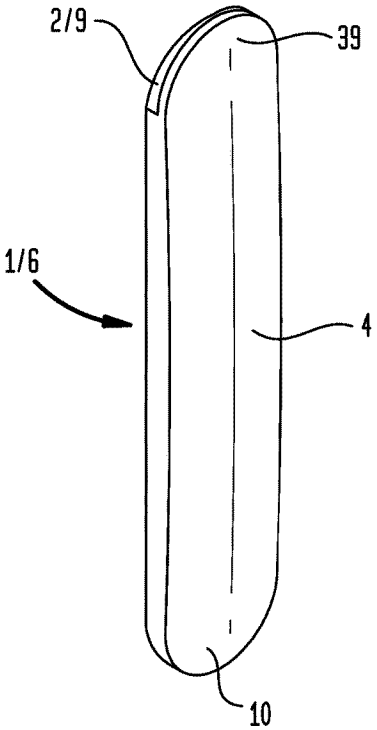
Figure 7:
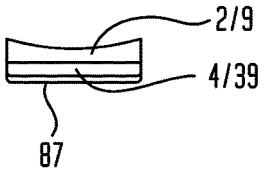
Figure 3:
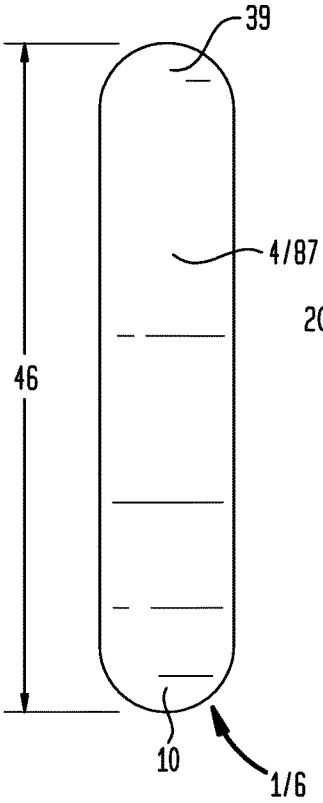
Figure 4:
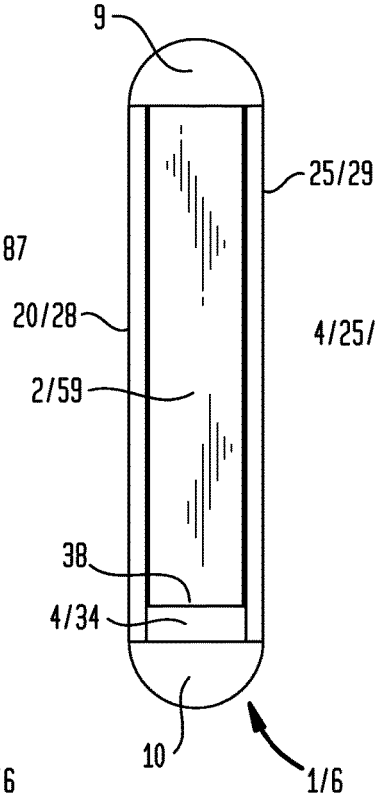
Figure 5:
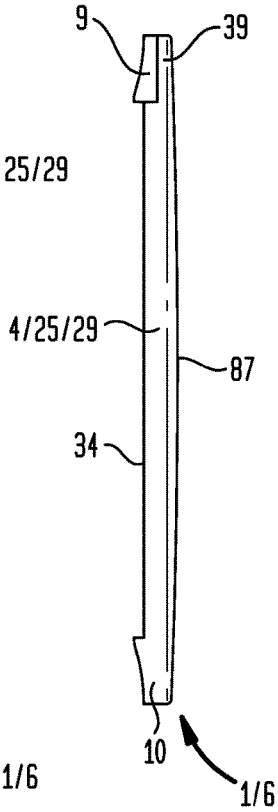
Figure 6:
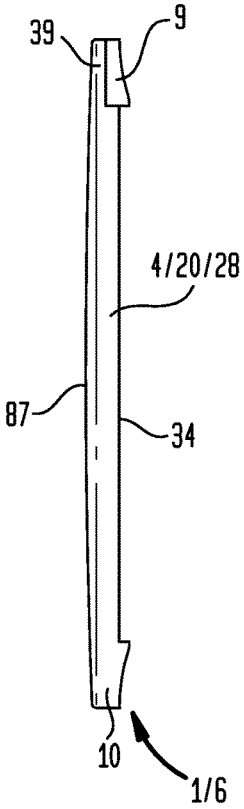
Figure 8:
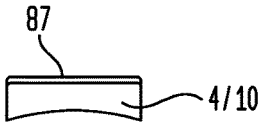
Figure 15:
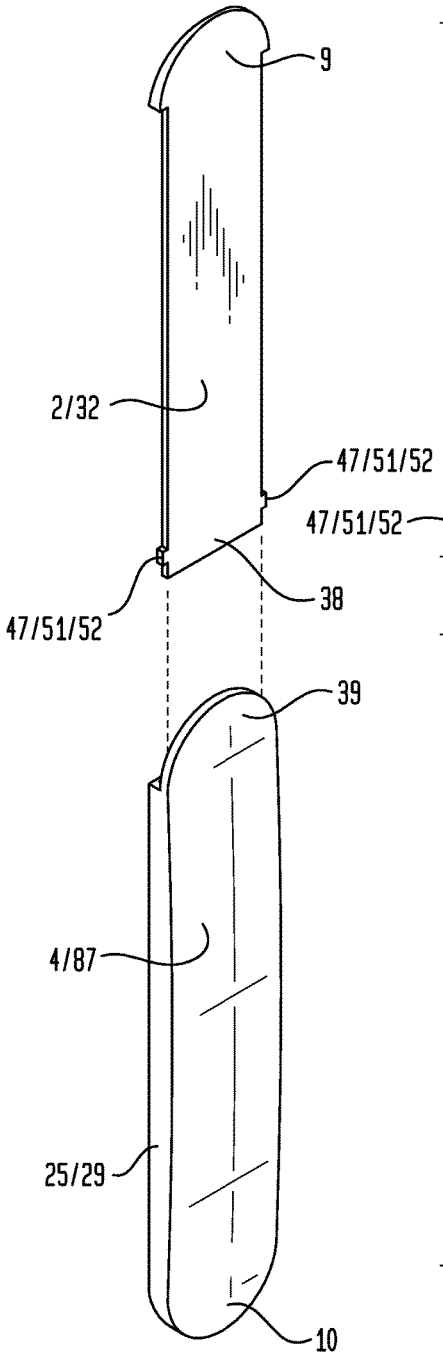
Figure 16:
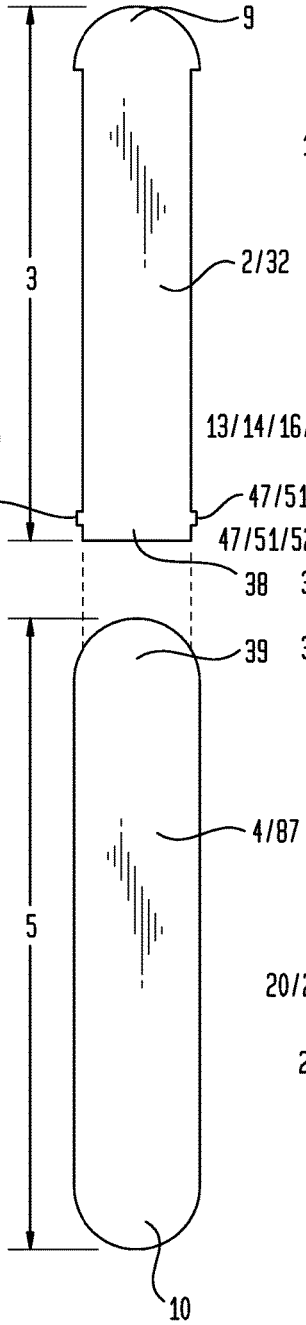
Figure 17:
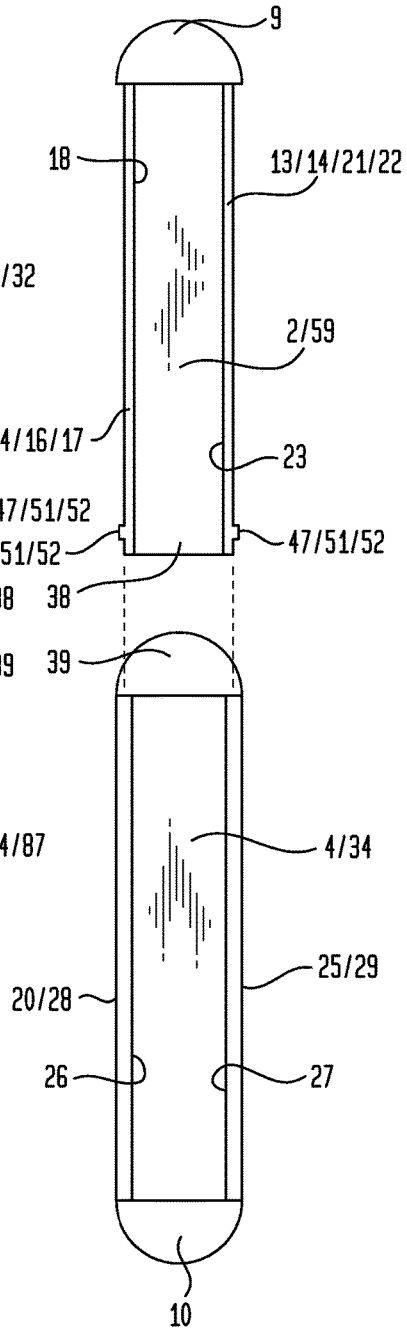
Figure 18:
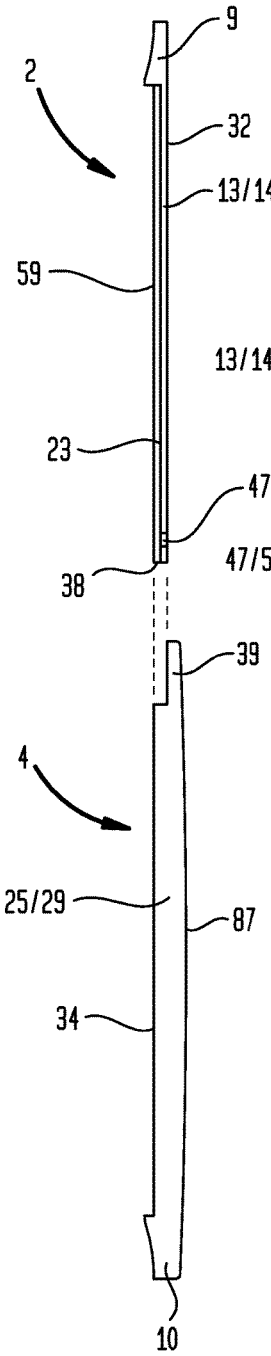
Figure 19:
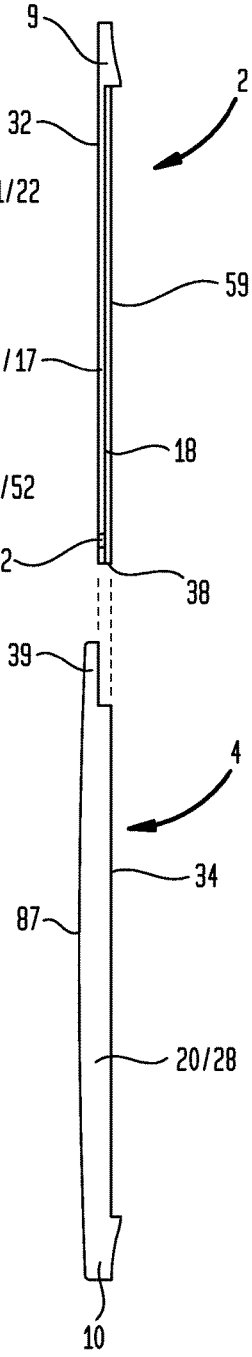
Figure 20A:
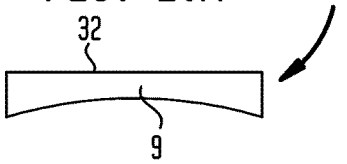
Figure 20B:
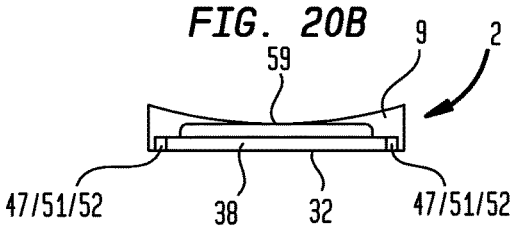
Figure 38:
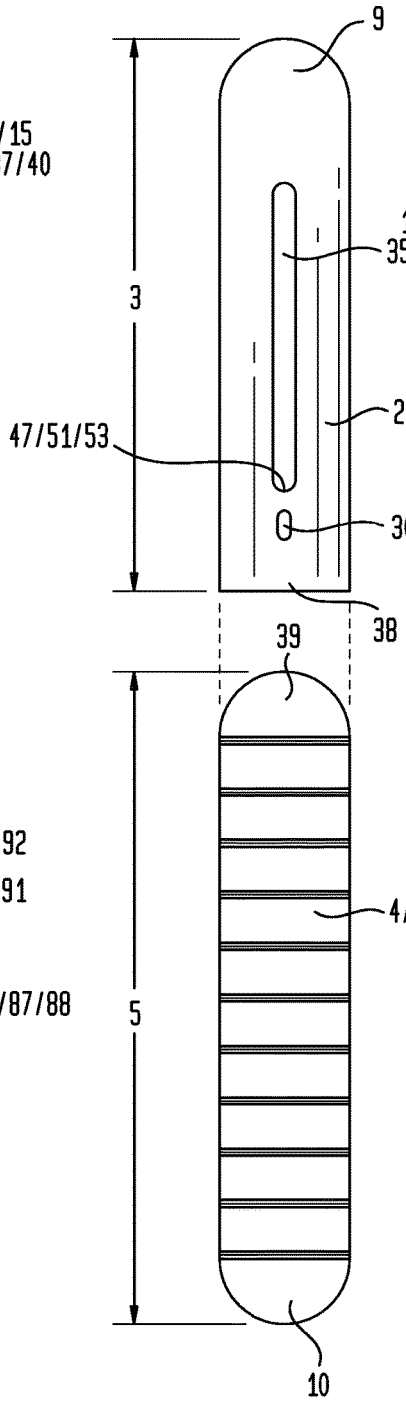
Figure 39:
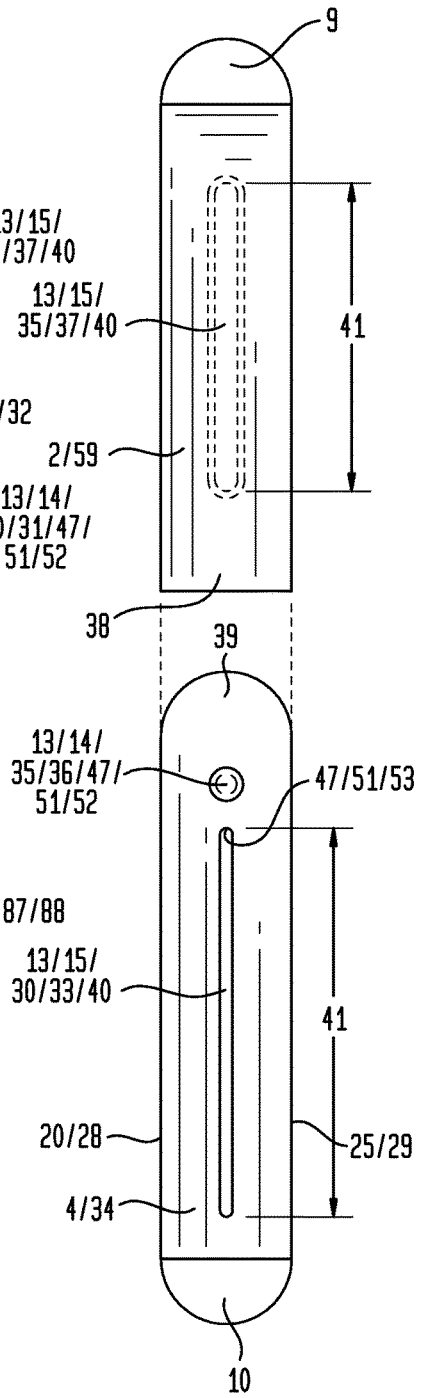
Figure 40:
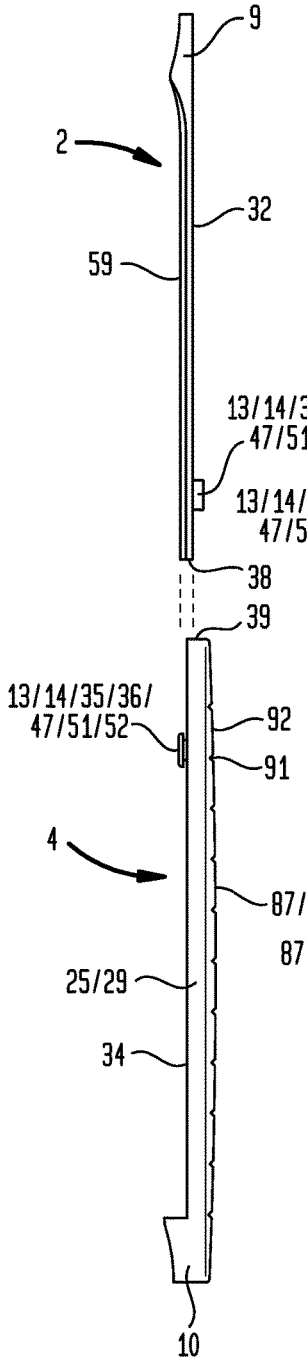
Figure 60:
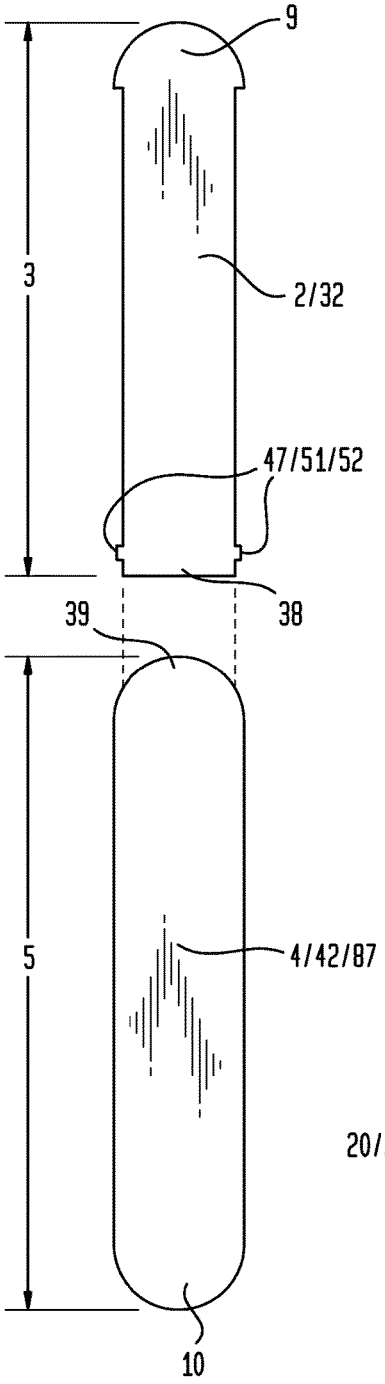
FIG. 60 is an exploded front view of a particular embodiment of a handle assembly including a first member and a second member adjustably overlappingly coupled along first and second member lengths by telescoping engagement.
Figure 61:
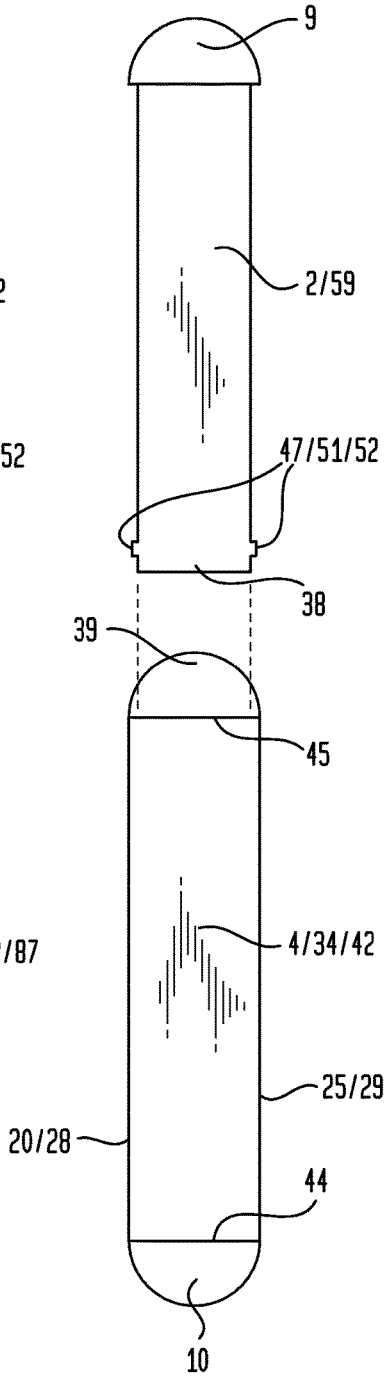
FIG. 61 is an exploded back view of a particular embodiment of a handle assembly including a first member and a second member adjustably overlappingly coupled along first and second member lengths by telescoping engagement.
Figure 62:
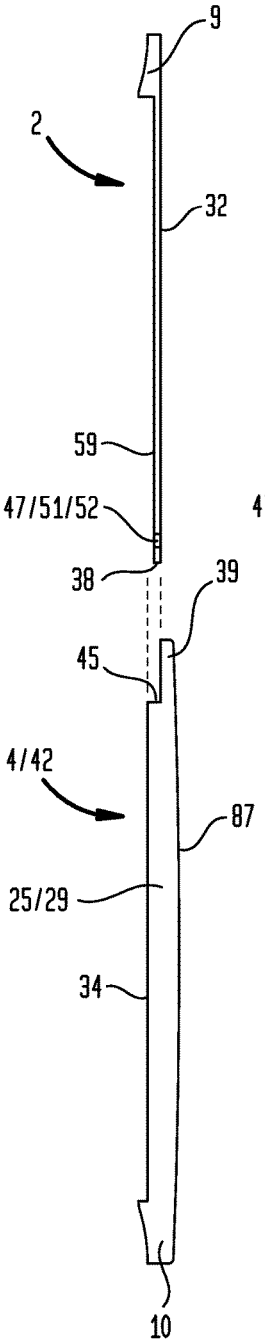
FIG. 62 is an exploded second side view of a particular embodiment of a handle assembly including a first member and a second member adjustably overlappingly coupled along first and second member lengths by telescoping engagement.
Figure 63:
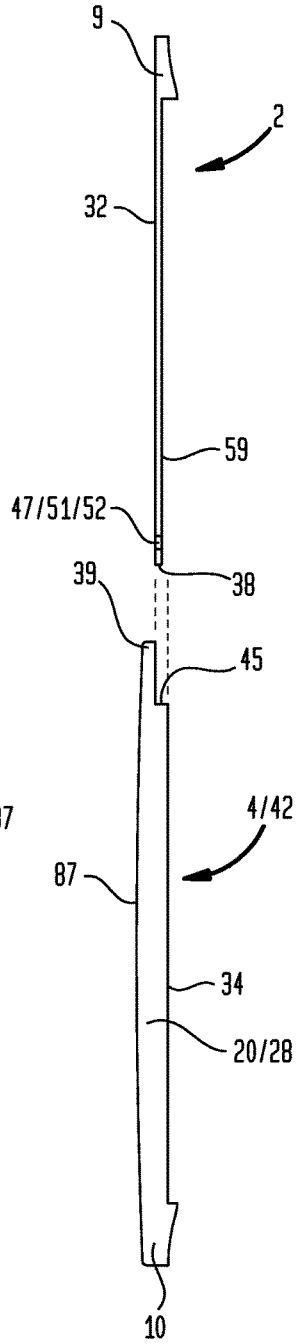
FIG. 63 is an exploded first side view of a particular embodiment of a handle assembly including a first member and a second member adjustably overlappingly coupled along first and second member lengths by telescoping engagement.
Figure 64A:
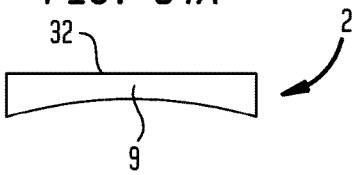
FIG. 64A is a first end view of a particular embodiment of a first member included in handle assembly having a first member and a second member adjustably overlappingly coupled along first and second member lengths by telescoping engagement.
Figure 64B:
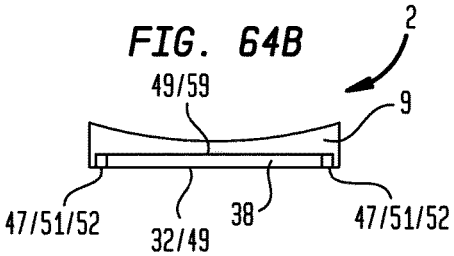
FIG. 64B is a second end view of a particular embodiment of a first member included in handle assembly having a first member and a second member adjustably overlappingly coupled along first and second member lengths by telescoping engagement.
Figure 65A:
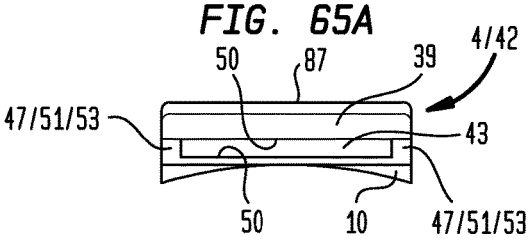
FIG. 65A is a first end view of a particular embodiment of a second member included in handle assembly having a first member and a second member adjustably overlappingly coupled along first and second member lengths by telescoping engagement.
Figure 65B:
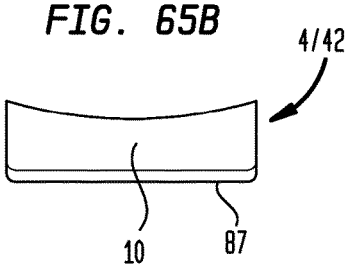
FIG. 65B is a second end view of a particular embodiment of a second member included in handle assembly having a first member and a second member adjustably overlappingly coupled along first and second member lengths by telescoping engagement.
Figure 66C:
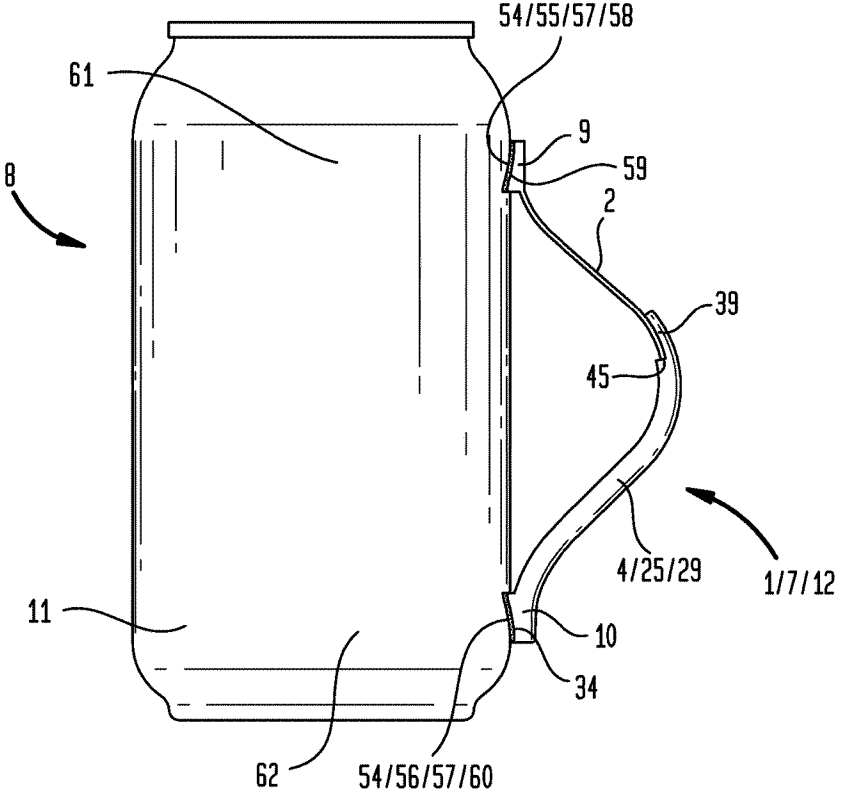
FIG. 66C is a second side view of a particular embodiment of a handle assembly including a first member and a second member adjustably overlappingly coupled along first and second member lengths by telescoping engagement, whereby the handle assembly disposes in an extended condition to provide a grippable element for grippably engaging the container.
Figure 66B:
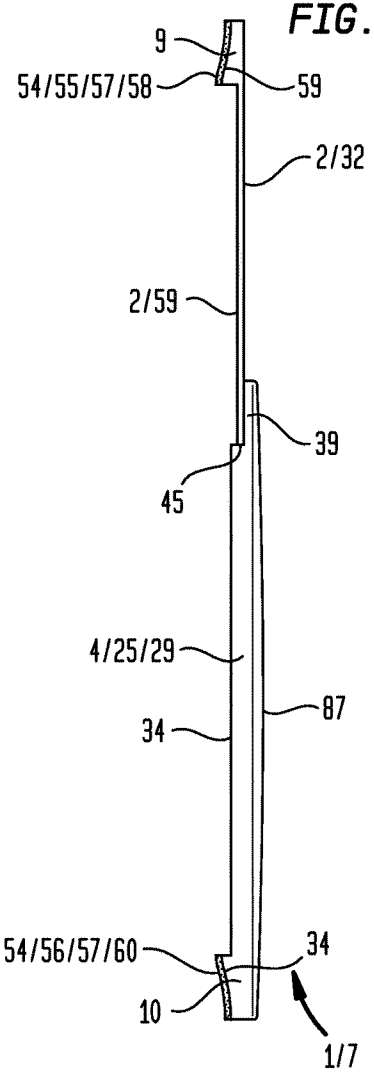
FIG. 66B is a second side view of a particular embodiment of a handle assembly including a first member and a second member adjustably overlappingly coupled along first and second member lengths by telescoping engagement, whereby the handle assembly disposes in an extended condition.
Figure 66A:
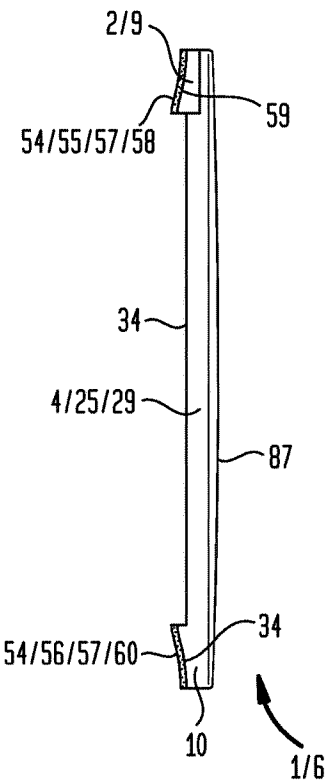
FIG. 66A is a second side view of a particular embodiment of a handle assembly including a first member and a second member adjustably overlappingly coupled along first and second member lengths by telescoping engagement, whereby the handle assembly disposes in a collapsed condition.
Figure 66E:
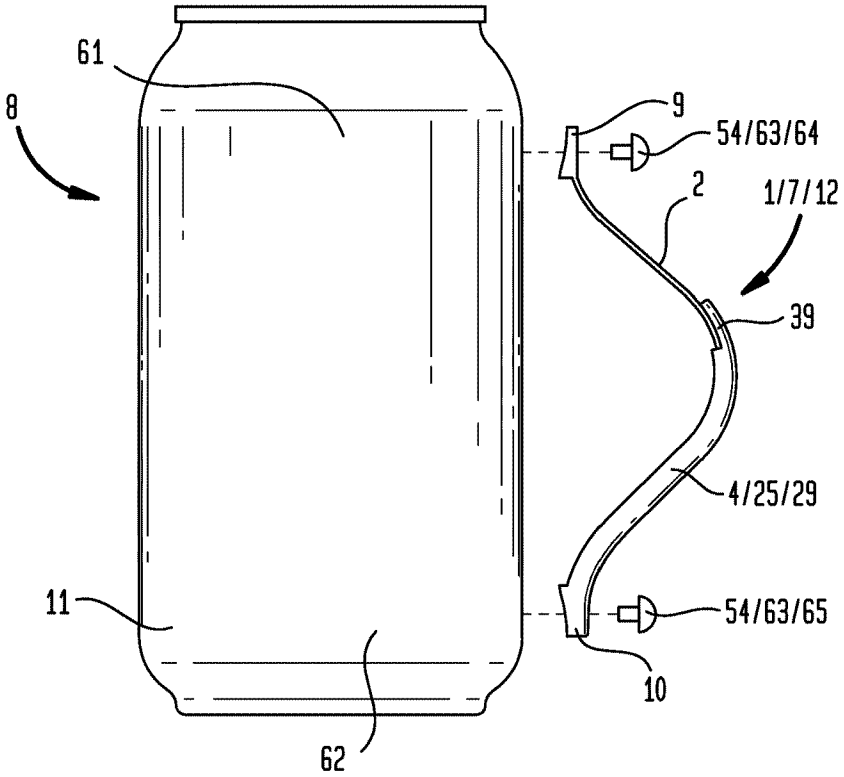
FIG. 66E is an exploded second side view of a particular embodiment of a handle assembly including a first member and a second member adjustably overlappingly coupled along first and second member lengths by telescoping engagement, whereby the handle assembly disposes in an extended condition to provide a grippable element for grippably engaging the container.
Figure 66D:
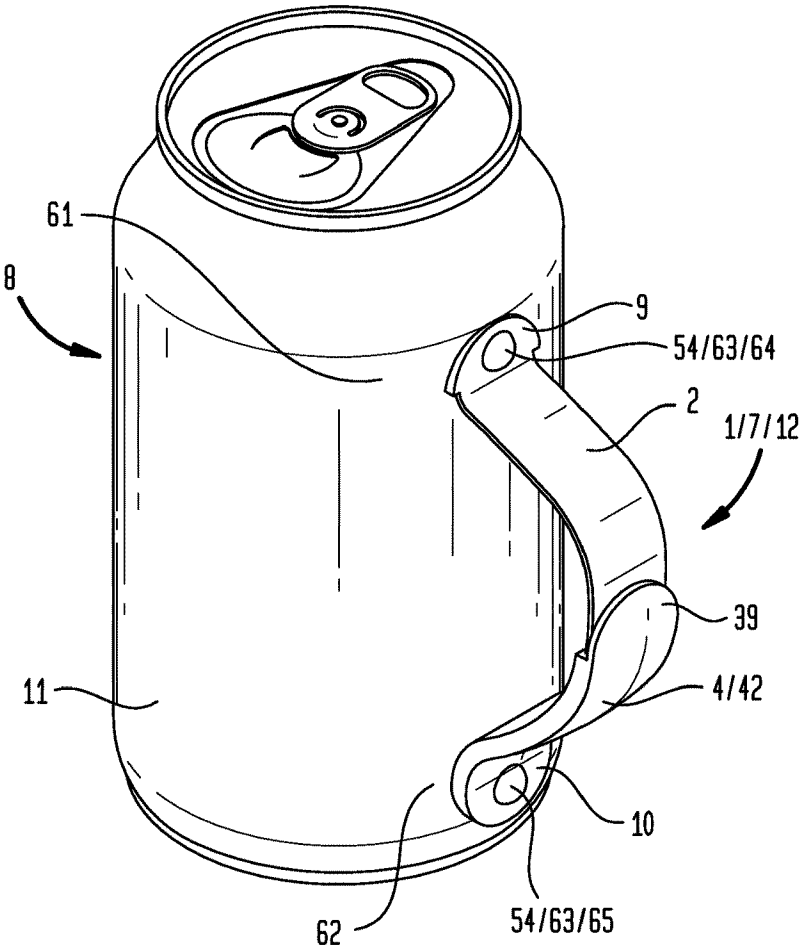
FIG. 66D is a perspective view of a particular embodiment of a handle assembly including a first member and a second member adjustably overlappingly coupled along first and second member lengths by telescoping engagement, whereby the handle assembly disposes in an extended condition to provide a grippable element for grippably engaging the container.

Now referring primarily to FIG. 1A through FIG. 66E, the handle assembly (1) can include a first member (2) having a first member length (3) and a second member (4) having a second member length (5) (as shown in the examples of FIG. 16, FIG. 38, and FIG. 60). The first and second members (2)(4) can adjustably overlappingly couple along the first and second member lengths (3)(5).

Now referring primarily to FIG. 1A through 44E, the handle assembly (1) can further include a pair of matable elements (13) coupled one each to the first and second members (2)(4). Upon mating engagement, the pair of matable elements (13) can couple the first and second members (2)(4) along the first and second member lengths (3)(5).

Again referring primarily to FIG. 1A through FIG. 44E, the pair of matable elements (13) can include a protrusion (14) and a recess (15) configured to receive the protrusion (14). As to particular embodiments, the protrusion (14) can outwardly extend from one of the first or second members (2)(4) and the recess (15) can be disposed within the other of the first or second members (2)(4). Upon mating engagement of the protrusion (14) within the recess (15), the first and second members (2)(4) can be overlappingly coupled to one another.

Now referring primarily to FIG. 1A through FIG. 22E, as to particular embodiments, the handle assembly (1) can include a first pair of matable elements (16), whereby a first protrusion (17) can outwardly extend from a first member first side surface (18) and a first recess (19) can be disposed within a second member first side surface (20). Coupling of the first protrusion (17) within the first recess (19) couples a portion of the first and second members (2)(4) along a portion of the first and second member first side surfaces (18)(20).

Again referring primarily to FIG. 1A through FIG. 22E, as to particular embodiments, the handle assembly (1) can further include a second pair of matable elements (21), whereby a second protrusion (22) can outwardly extend from a first member second side surface (23) and a second recess (24) can be disposed within a second member second side surface (25). Coupling of the second protrusion (22) within the second recess (24) couples a portion of the first and second members (2)(4) along a portion of the first and second member second side surfaces (23)(25).

Figure 21A:
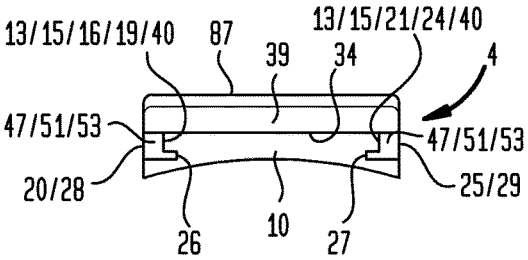
Figure 21B:
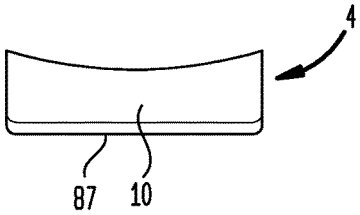
Figure 22C:
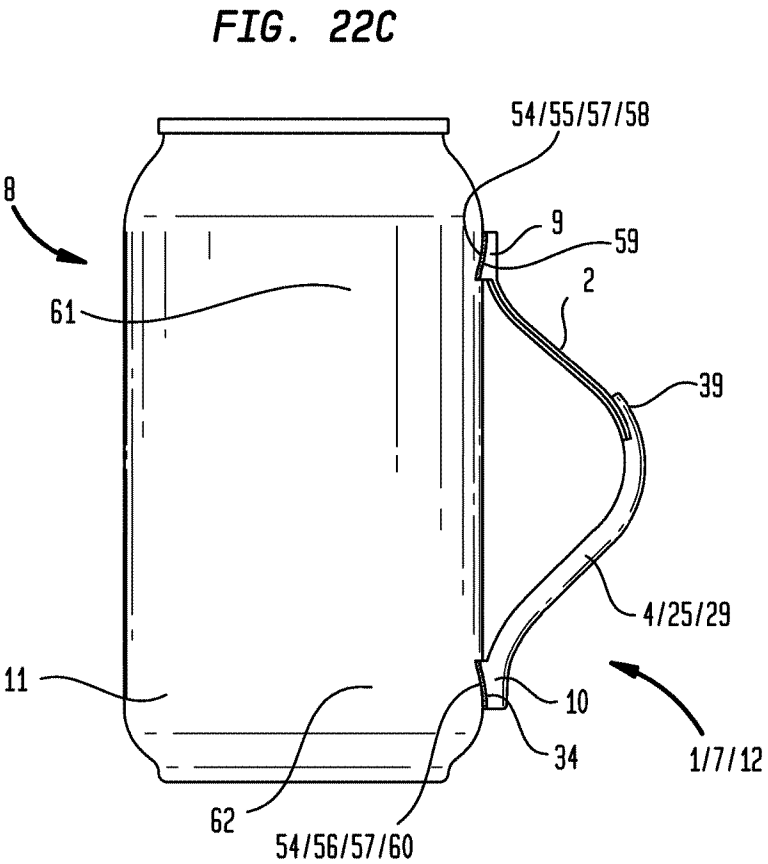
Figure 22B:
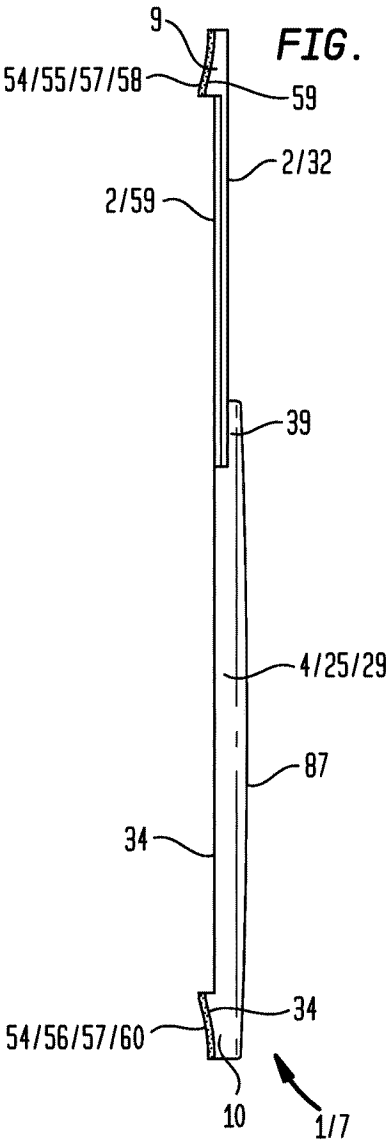
Figure 22A:
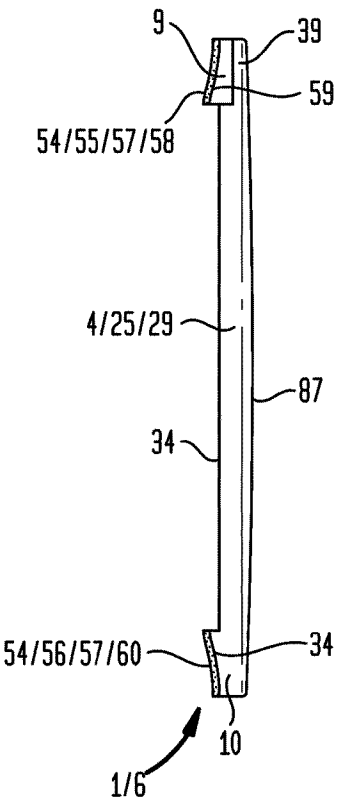
Figure 22E:
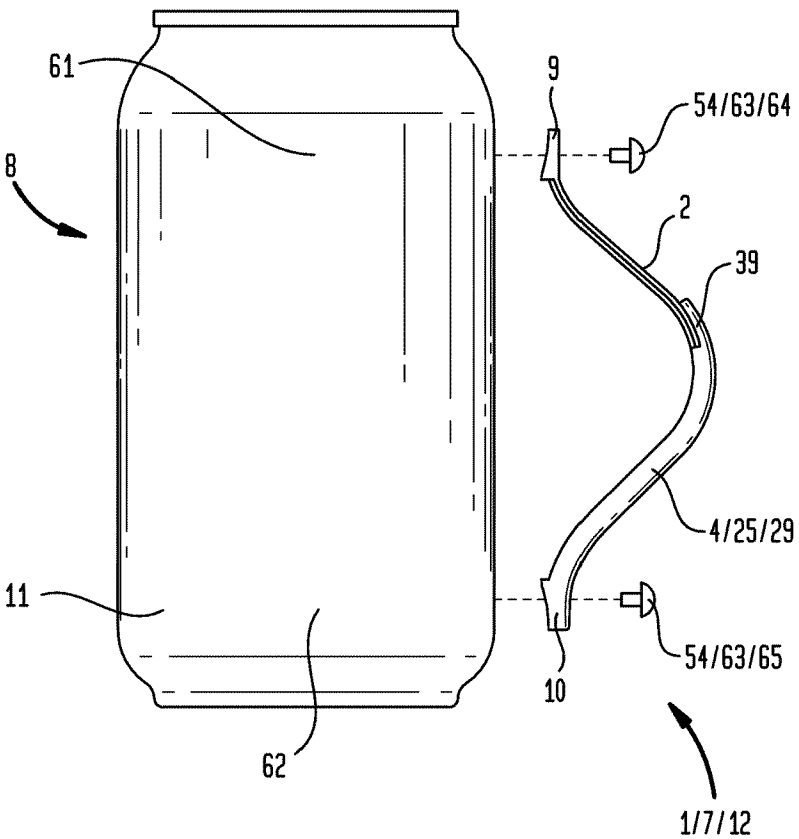
Figure 22D:
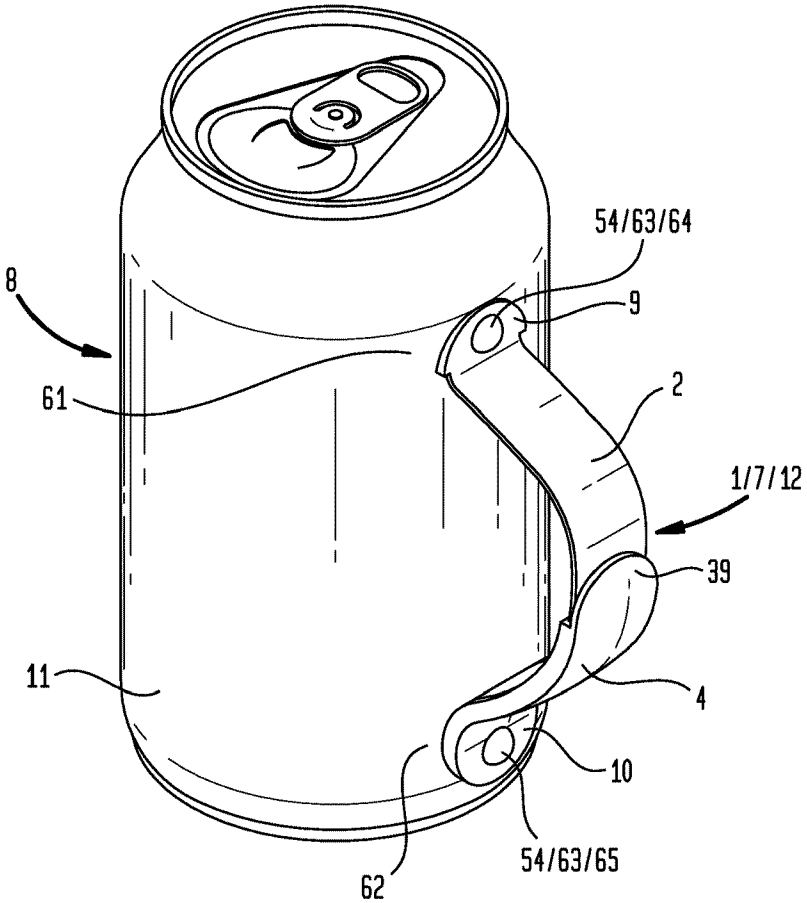

As to particular embodiments, the first or second recess (19)(24) can dispose proximate a corresponding second member first or second side internal surface (26)(27) (as shown in the examples of FIG. 1A through FIG. 22E, and in particular, in FIG. 21A). As to other particular embodiments, the first or second recess (19)(24) can dispose proximate a corresponding second member first or second side external surface (28)(29) (not shown). As to yet other particular embodiments, the first or second recess (19)(24) can be configured as an aperture element having an aperture element opening correspondingly communicating between second member first side internal and external surfaces (26)(28) or between second member second side internal and external surfaces (27)(29) (not shown).

Now referring primarily to FIG. 23A through FIG. 44E, as to particular embodiments, the handle assembly (1) can include a third pair of matable elements (30), whereby a third protrusion (31) can outwardly extend from a first member front surface (32) and a third recess (33) can be disposed within a second member back surface (34) (as shown in the examples of FIG. 32, FIG. 37 through FIG. 39, and FIG. 40 through FIG. 42B). Coupling of the third protrusion (31) within the third recess (33) couples a portion of the first and second members (2)(4) along a portion of the first member front surface (32) and the second member back surface (34).

Again referring primarily to FIG. 23A through FIG. 44E, as to particular embodiments, the handle assembly (1) can further include a fourth pair of matable elements (35), whereby a fourth protrusion (36) can outwardly extend from the second member back surface (34) and a fourth recess (37) can be disposed within the first member front surface (32) (as shown in the examples of FIG. 23B, FIG. 24B, FIG. 24C, FIG. 26, FIG. 31, FIG. 32, FIG. 37 through FIG. 41, and FIG. 43A). Coupling of the fourth protrusion (36) within the fourth recess (37) couples a portion of the first and second members (2)(4) along a portion of the first member front surface (32) and the second member back surface (34).

As to particular embodiments, the third or fourth recess (33)(37) can dispose proximate a corresponding second member back surface (34) or first member front surface (32) (as shown in the examples of FIG. 23A through FIG. 44E). As to other particular embodiments, the third or fourth recess (33)(37) can be configured as an aperture element having an aperture element opening correspondingly communicating between the second member back and front surfaces (34)(87) or between the first member front and back surfaces (32)(59) (not shown).

Again referring primarily to FIG. 23A through FIG. 44E, as to particular embodiments having the third and four pair of matable elements (30)(35) as described above, the third protrusion (31) can be disposed proximate a first member second end (38), the third recess (33) can be disposed proximate the second member first end (10), the fourth protrusion (36) can be disposed proximate a second member second end (39), and the fourth recess (37) can be disposed proximate the first member first end (9), whereby the third protrusion (31) can be received within the third recess (33) and the fourth protrusion (36) can be received within the fourth recess (37) to couple a portion of the first and second members (2)(4) along a portion of the first member front surface (32) and the second member back surface (34).

Figure 41:
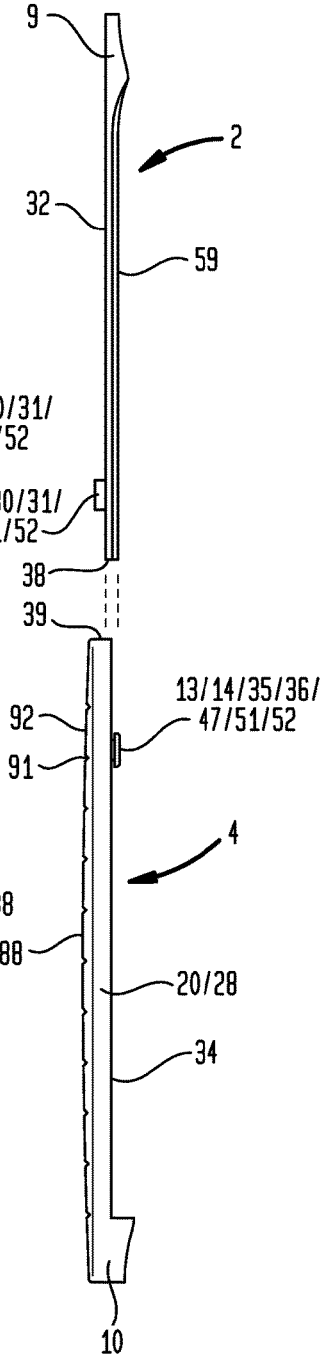
Figure 42A:
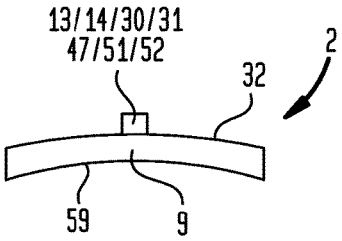
Figure 42B:
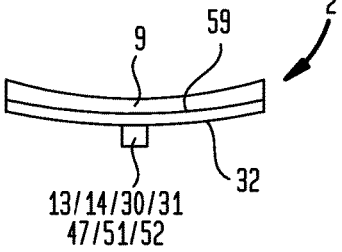
Figure 43A:
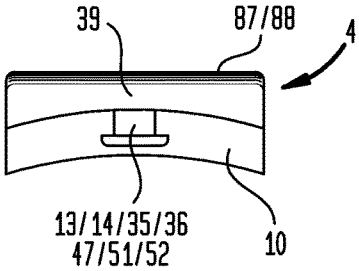
Figure 43B:
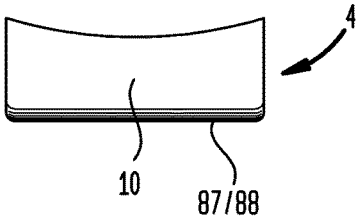
Figure 44C:
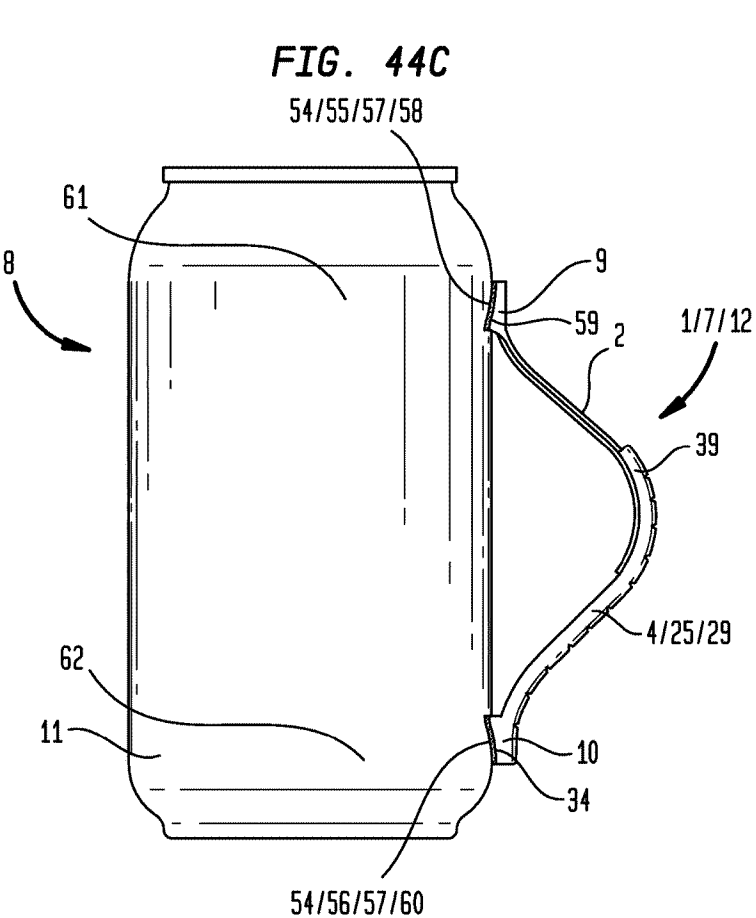
Figure 44B:
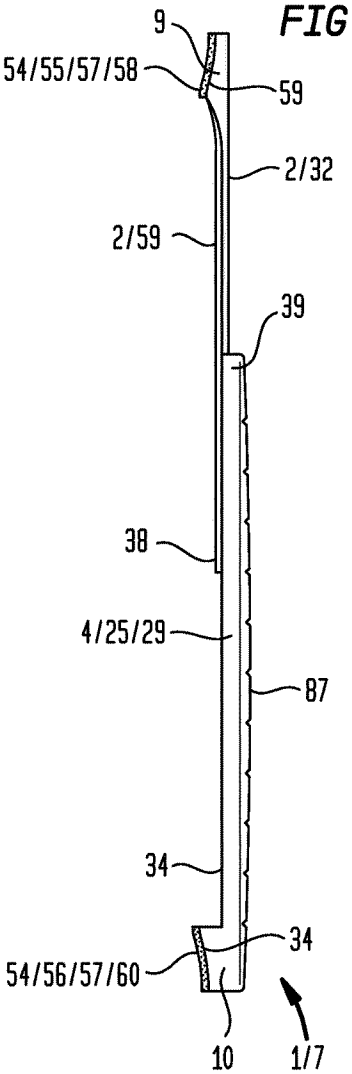
Figure 44A:
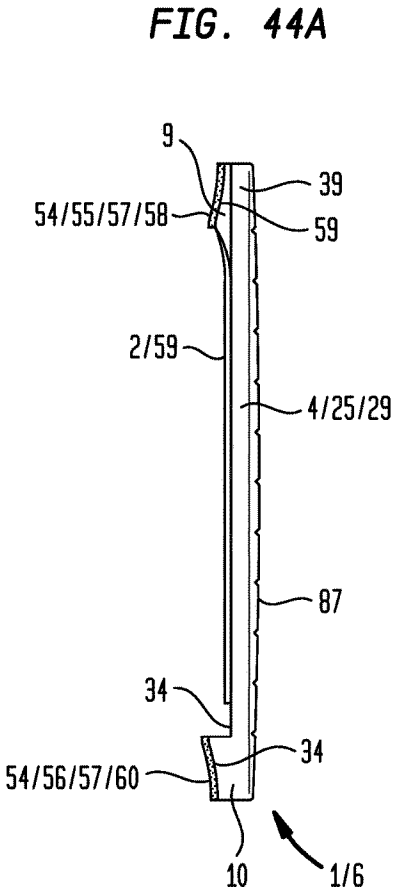
Figure 44E:
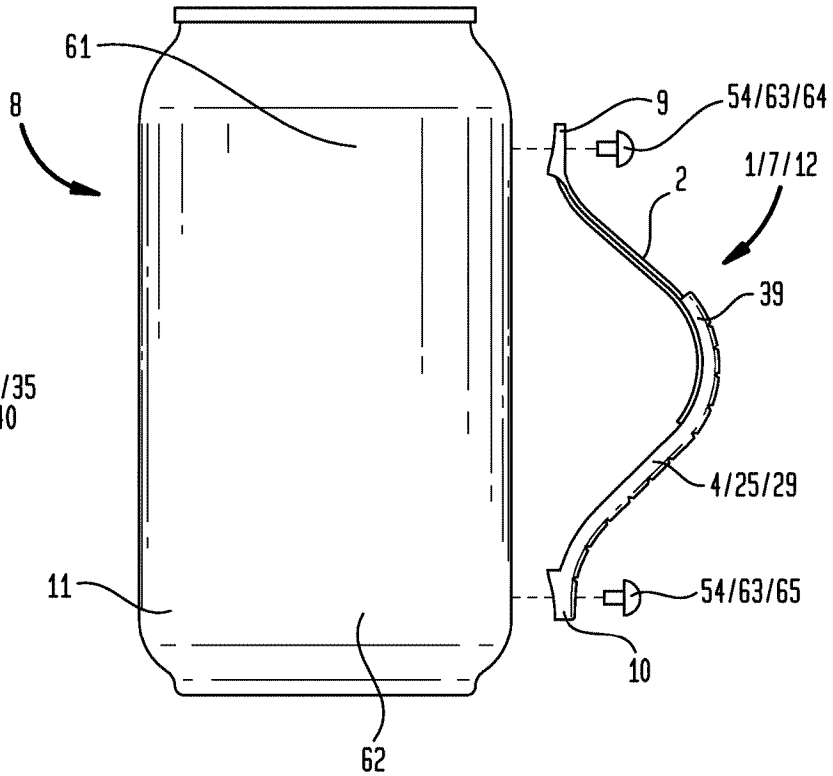
Figure 44D:
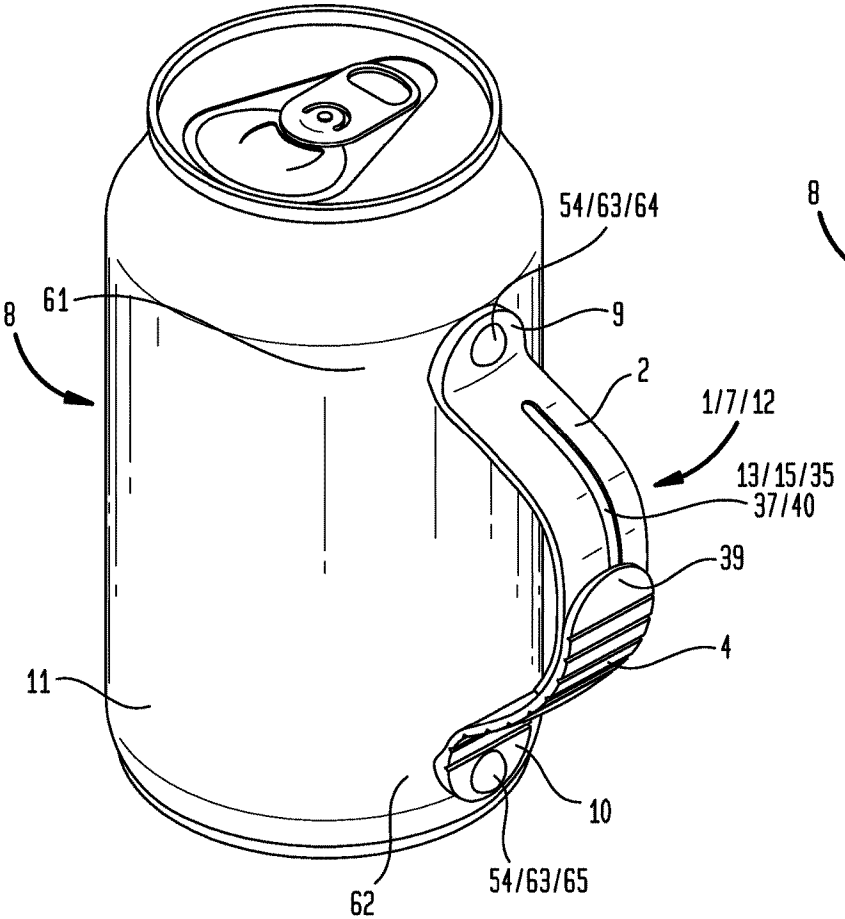

Now referring primarily to FIG. 1A through FIG. 44E, the recess (15) can comprise an elongate recess (40). Following, the protrusion (14) can be slidable within the elongate recess (40) along an elongate recess length (41) (as shown in the example of FIG. 41) to allow the first and second members (2)(4) to slidably adjust between the collapsed and extended conditions (6)(7).

Now referring primarily to FIG. 45A through FIG. 66E, as to particular embodiments, the first and second members (2)(4) can adjustably overlappingly couple along the first and second member lengths (3)(5) by telescopingly engaging with one another. As an illustrative example, the second member (4) can be configured as a tubular second member (42) having a passage (43) between a second member closed first end (44) and a second member open second end (45). The first member (2) can telescopingly engage within the passage (43), whereby the first member (2) can be slidable within the passage (43) to allow the first and second members (2)(4) to slidably adjust between the collapsed and extended conditions (6)(7).

Now referring primarily to FIG. 1A through FIG. 66E, the first and second members (2)(4) can adjustably overlappingly couple along the first and second member lengths (3)(5) such that first and second member first ends (9)(10) dispose in opposed relation. In the collapsed condition (6), the first member first end (9) can dispose proximate the second member second end (39) and the first member second end (38) can dispose proximate the second member first end (10) (as shown in the examples of FIG. 3 through FIG. 8, FIG. 25 through FIG. 30, and FIG. 47 through FIG. 52), whereby this configuration can provide the handle assembly (1) with a lesser handle assembly length (46) in relation to the extended condition (7) (as shown in the examples of FIG. 3, FIG. 9, FIG. 25, FIG. 31, FIG. 47, and FIG. 53). Upon slidably adjusting toward the extended condition (7), the first member second end (38) can slidably adjust toward the second member second end (39), thereby disposing the first member first end (9) distal from the second member second end (39) and disposing the first member second end (38) distal from the second member first end (10) (as shown in the examples of FIG. 9 through FIG. 14, FIG. 31 through FIG. 36, and FIG. 53 through FIG. 58), whereby this configuration can provide the handle assembly (1) with a greater handle assembly length (46) in relation to the collapsed condition (6) (as shown in the examples of FIG. 3, FIG. 9, FIG. 25, FIG. 31, FIG. 47, and FIG. 53).

As to particular embodiments, the handle assembly (1) can further include a securement element (47) configured to positionally secure the first member length (3) along the second member length (5) upon a desired amount of slidable adjustment between the collapsed and extended conditions (6)(7). Accordingly, the securement element (47) can preclude the first and second members (2)(4) from slidably adjusting further between the collapsed and extended conditions (6)(7) or from disengaging from one another.

Now referring primarily to FIG. 1A through FIG. 44E, as to particular embodiments having a pair of matable elements (13) configured as a protrusion (14) and a corresponding recess (15), the securement element (47) can include frictional forces between the protrusion (14) and at least one wall bounding the recess (15) which receives the protrusion (14) to matably couple the first and second members (2)(4) along the first and second member lengths (3)(5); as such, the handle assembly (1) can have a variably adjustable handle assembly length (46), securable at any handle assembly length (46) between the collapsed and extended conditions (6)(7).

Now referring primarily to FIG. 45A through FIG. 66E, as to particular embodiments having a first member (2) which telescopingly engages within a passage (43) of a tubular second member (42), the securement element (47) can include frictional forces between a first member external surface (49) and a second member internal surface (50) bounding the passage (43) which telescopingly receives the first member (2) to matably couple the first and second members (2)(4) along the first and second member lengths (3)(5); as such, the handle assembly (1) can have a variably adjustable handle assembly length (46), securable at any handle assembly length (46) between the collapsed and extended conditions (6)(7).

Now referring primarily to FIG. 15 through FIG. 19, FIG. 20B, FIG. 21A, FIG. 37 through FIG. 43A, and FIG. 59 through FIG. 63, FIG. 64B, and FIG. 65A, as to particular embodiments, the securement element (47) can include a catch assembly (51) configured to limit travel of the first member (2) in relation to the second member (4) along the second member length (5). As to particular embodiments, the catch assembly (51) can include first and second catch elements (52)(53) coupled one each to the first and second members (2)(4). Upon engagement, the first and second catch elements (52)(53) can positionally secure the first member length (3) along the second member length (5). Accordingly, the first and second catch elements (52)(53) can preclude the first and second members (2)(4) from slidably adjusting further between the collapsed and extended conditions (6)(7) or from disengaging from one another. As to particular embodiments, the handle assembly (1) can include a plurality of catch assemblies (51), which can allow the handle assembly (1) to adjust between a corresponding plurality of discrete handle assembly lengths (46), securable at any handle assembly length (46) between the collapsed and extended conditions (6)(7) whereby first and second catch elements (52)(53) securely engage with one another.

As to particular embodiments, the securement element (47) can include a ratchet mechanism having one or more teeth and at least one pawl (not shown). As an illustrative example, the teeth can be coupled to the first member (2) and the pawl can be coupled to the second member (4) such that the pawl can engage with the teeth to limit travel of the first member (2) in relation to the second member (4).

Now referring primarily to FIG. 22A through FIG. 22E, FIG. 44A through FIG. 44E, and FIG. 66A through FIG. 66E, the handle assembly (1) can further include a coupling element (54) configured to couple the handle assembly (1) to a container (8). As to particular embodiments, a first coupling element (55) can be coupled to the first member first end (9) and a second coupling element (56) can be coupled to the second member first end (10), whereby the first and second coupling elements (55)(56) can be configured to couple the corresponding first and second member first ends (9)(10) to the container (8).

Now referring primarily to FIG. 22A through FIG. 22C, FIG. 44A through FIG. 44C, and FIG. 66A through FIG. 66C, as to particular embodiments, the coupling element (54) can include an adherent layer (57) capable of coupling the handle assembly (1) to the container wall (11) of the container (8). The adherent layer (57) can include at least one, one or more, or a combination of a numerous and wide variety of adhesives suitable for coupling the handle assembly (1) to the container wall (11) in releasable fixed relation or in fixed relation. As an illustrative example, the adherent layer (57) can include non-reactive adhesives such as drying adhesives, pressure-sensitive adhesives, contact adhesives, hot adhesives, or the like, or combinations thereof; reactive adhesives including one-part adhesives or multi-part adhesives; natural adhesives; synthetic adhesives; or the like, or combinations thereof. As to particular embodiments, the adherent layer (57) can include a food grade adhesive which can be capable of coupling a polymer, such as plastic, with a metal, such as aluminum. For example, food grade adhesives suitable for use in embodiments of the handle assembly (1) can include Product EP42HT-2FG, a Two Component, Room Temperature Setting, Heat Resistant Epoxy System for Bonding, Sealing, Coating & Casting Specially Formulated for Food Applications; Product EP30HT, a Two Component, Room Temperature Curing Epoxy for High Performance Bonding, Sealing, Coating and Potting Featuring Optical Clarity and High Temperature Resistance, which conforms to FDA Section 175.105 for indirect food applications; Product EP30HV, a Two Component, Room Temperature Curing Epoxy System for High Performance Bonding, Sealing, Coating and Potting Featuring Excellent Physical Strength Properties and Optical Clarity, which meets FDA Chapter 1, Section 175.105 for indirect food applications; whereby Product EP42HT-2FG, Product EP30HT, or Product EP30HV can be obtained from Master Bond, Inc., 154 Hobart Street, Hackensack, N.J. 07601, USA. However, the invention need not be so limited, as any of a numerous and wide variety of food grade adhesives can be useful for coupling the handle assembly (1) to the container wall (11) in releasable fixed relation or in fixed relation.

Again referring primarily to FIG. 22A through FIG. 22C, FIG. 44A through FIG. 44C, and FIG. 66A through FIG. 66C, as to particular embodiments, a first adherent layer (58) can be coupled to the first member first end (9) proximate the first member back surface (59) and a second adherent layer (60) can be coupled to the second member first end (10) proximate the second member back surface (34), thereby facilitating coupling each of the first and second member first ends (9)(10) to the container wall (11). As an illustrative example, the first adherent layer (58) can couple the first member first end (9) to a container wall upper portion (61) and the second adherent layer (60) can couple the second member first end (10) to a container wall lower portion (62), thereby facilitating coupling of the handle assembly (1) to the container (8).

Now referring primarily to FIG. 22D and FIG. 22E, FIG. 44D and FIG. 44E, and FIG. 66D and FIG. 66E, as to other particular embodiments, the coupling element (54) can include a mechanical fastener (63) capable of coupling the handle assembly (1) to the container wall (11) of the container (8). The mechanical fastener (63) can include at least one, one or more, or a combination of a wide variety of mechanical fasteners (63) suitable for coupling the handle assembly (1) to the container wall (11) in releasable fixed relation or in fixed relation. As an illustrative example, mechanical fasteners (63) can include buckles, buttons, pins, rivets, snap fasteners, threaded fasteners, or the like, or combinations thereof. As to particular embodiments, a first rivet (64) can be coupled to the first member first end (9) and a second rivet (65) can be coupled to the second member first end (10), thereby facilitating coupling each of the first and second member first ends (9)(10) to the container wall (11). As an illustrative example, the first rivet (64) can couple the first member first end (9) to the container wall upper portion (61) and the second rivet (65) can couple the second member first end (10) to the container wall lower portion (62), thereby facilitating coupling of the handle assembly (1) to the container (8).

A method of making a particular embodiment of the handle assembly (1) can include providing a first member (2) having a first member length (3); providing a second member (4) having a second member length (5); and adjustably overlappingly coupling the first and second members (2)(4) along the first and second member lengths (3)(5); whereby the handle assembly (1) is adjustable between a collapsed condition (6), having greater portions of the first and second member lengths (3)(5) overlappingly engaged, and an extended condition (7), having lesser portions of the first and second member lengths (3)(5) overlappingly engaged.

The method of making the handle assembly (1) can further include coupling a pair of matable elements (13) one each to the first and second members (2)(4), whereby upon mating engagement, the pair of matable elements (13) can couple the first and second members (2)(4) along the first and second member lengths (3)(5). As to particular embodiments, the method of making the handle assembly (1) can further include configuring the pair of matable elements (13) as a protrusion (14) and a recess (15) capable of receiving the protrusion (14). As to particular embodiments, the method of making the handle assembly (1) can further include configuring the recess (15) as an elongate recess (40), whereby the protrusion (14) is slidable within the elongate recess (40) to allow the first and second members (2)(4) to slidably adjust between the collapsed and extended conditions (6)(7).

The method of making the handle assembly (1) can further include providing a securement element (47) configured to positionally secure the first member length (3) along the second member length (5).

The method of making the handle assembly (1) can further include coupling a first coupling element (55) to a first member first end (9) and coupling a second coupling element (56) to a second member first end (10), whereby the first and second coupling elements (55)(56) are configured to couple each of the corresponding first and second member first ends (9)(10) to the container (8). As to particular embodiments, the first coupling element (55) can include a first adherent layer (58) coupled to the first member first end (9) proximate a first member back surface (59) and the second coupling element (56) can include a second adherent layer (60) coupled to the second member first end (10) proximate a second member back surface (34). As to particular embodiments, the first and second adherent layers (58)(60) can include a food grade adhesive. As to other particular embodiments, the first and second coupling elements (55)(56) can include mechanical fasteners (63).

The method of making the handle assembly (1) can further include telescopingly engaging the first and second members (2)(4) along the first and second member lengths (3)(5). As to particular embodiments, the method of making the handle assembly (1) can further include configuring the second member (4) as a tubular second member (42) having a passage (43) between a second member closed first end (44) and a second member open second end (45), whereby the first member (2) telescopingly engages within the passage (43), and whereby the first member (2) is slidable within the passage (43) to allow the first and second members (2)(4) to slidably adjust between the collapsed and extended conditions (6)(7).

The method of making the particular embodiment of the handle assembly (1) having telescopingly engaged first and second members (2)(4) can further include providing a securement element (47) configured to positionally secure the first member length (3) along the second member length (5).

The method of making the particular embodiment of the handle assembly (1) having telescopingly engaged first and second members (2)(4) can further include coupling a first coupling element (55) to a first member first end (9) and coupling a second coupling element (56) to a second member first end (10), whereby the first and second coupling elements (55)(56) can be configured to couple each of the corresponding first and second member first ends (9)(10) to the container (8). As to particular embodiments, the first coupling element (55) can include a first adherent layer (58) coupled to the first member first end (9) proximate a first member back surface (59) and the second coupling element (56) can include a second adherent layer (60) coupled to the second member first end (10) proximate a second member back surface (34). As to particular embodiments, the first and second adherent layers (58)(60) can include a food grade adhesive. As to other particular embodiments, the first and second coupling elements (55)(56) can include mechanical fasteners (63).

Now referring primarily to FIG. 1A and FIG. 1B, FIG. 22C through FIG. 22E, FIG. 23A and FIG. 23B, FIG. 44C through FIG. 44E, FIG. 45A and FIG. 45B, and FIG. 66C through FIG. 66E, a method of using a particular embodiment of the handle assembly (1) for grippably engaging a container (8) can include obtaining a handle assembly (1) configured as described above, whereby the handle assembly (1) is coupled to the container (8) by coupling of first and second member first ends (9)(10) to a container wall (11), can include adjusting the handle assembly (1) between the collapsed condition (6), in which the first and second member lengths (3)(5) dispose proximate the container wall (11), and the extended condition (7) by outwardly extending the first and second member lengths (3)(5) away from the container wall (11) to provide a grippable element (12) for grippably engaging the container (8). As to particular embodiments, adjusting the handle assembly (1) between the collapsed and extended conditions (6)(7) can include slidably adjusting the first and second members (2)(4) between the collapsed and extended conditions (6)(7).

The method of using the handle assembly (1) can further include securing said handle assembly (1) in the extended condition (7) with a securement element (47).

The method of using the handle assembly (1) can further include gripping the grippable element (12) to grippably engage the container (8).

Figure 23B:
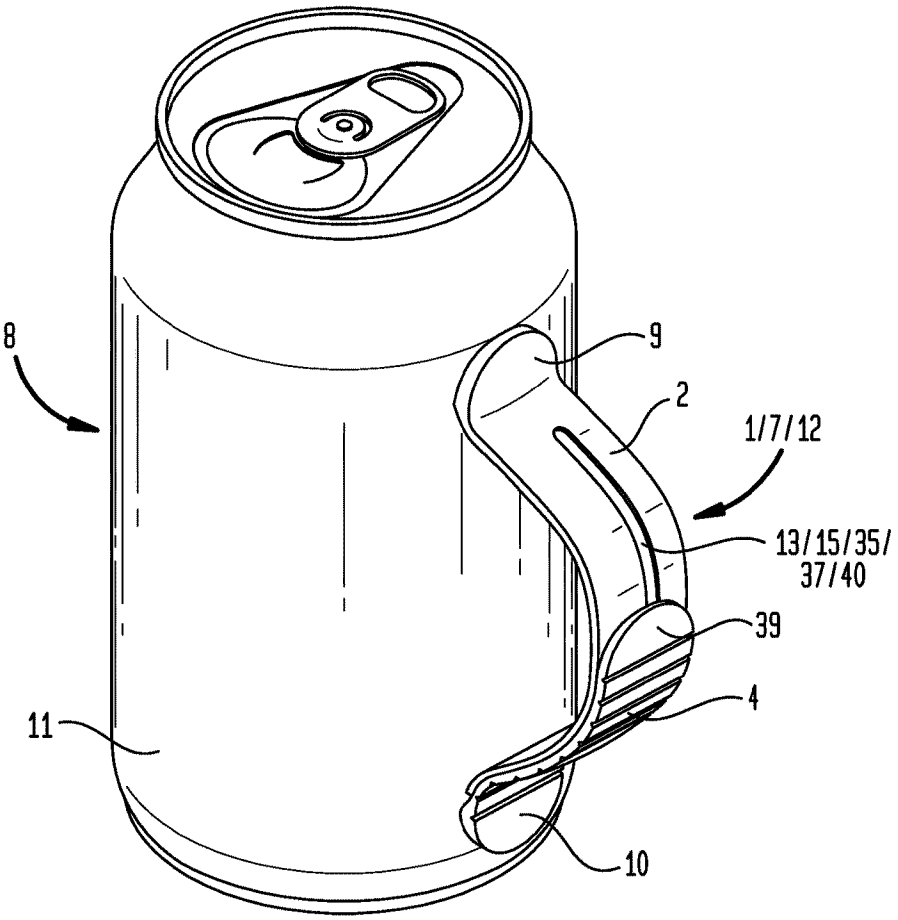
Figure 23A:
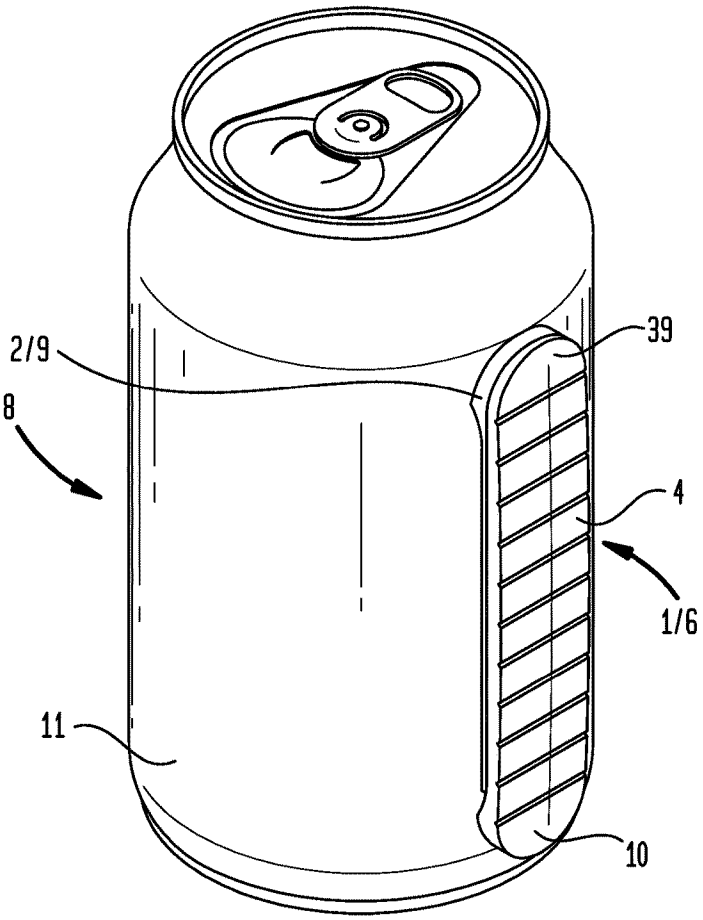
Figure 24C:
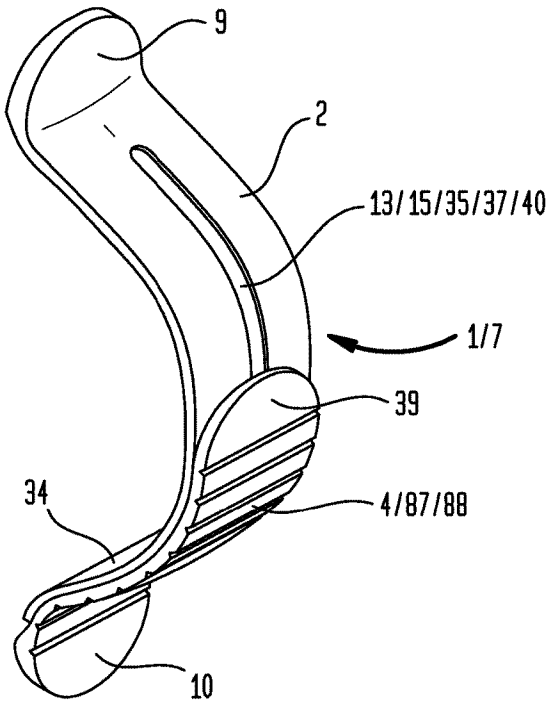
Figure 24B:
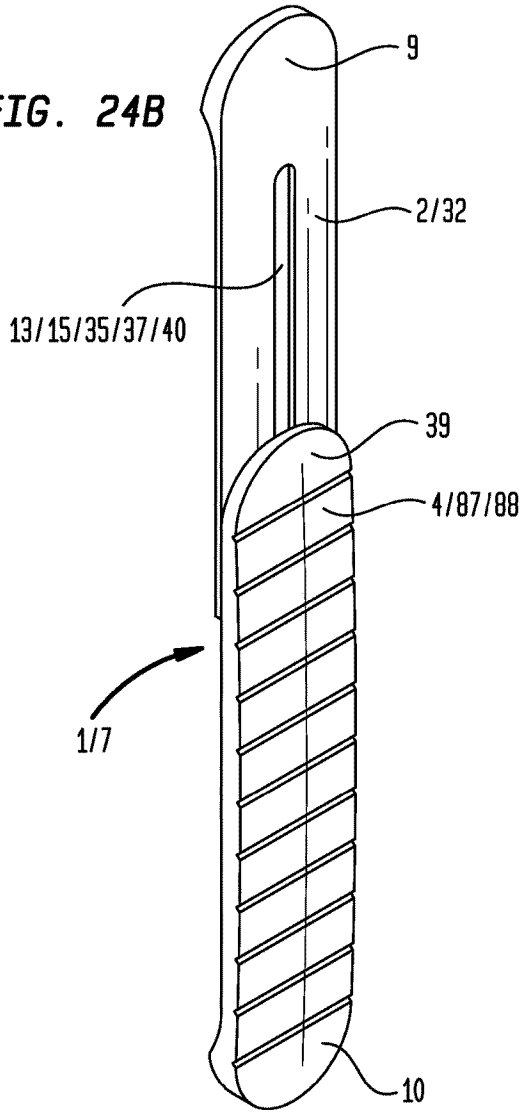
Figure 24A:
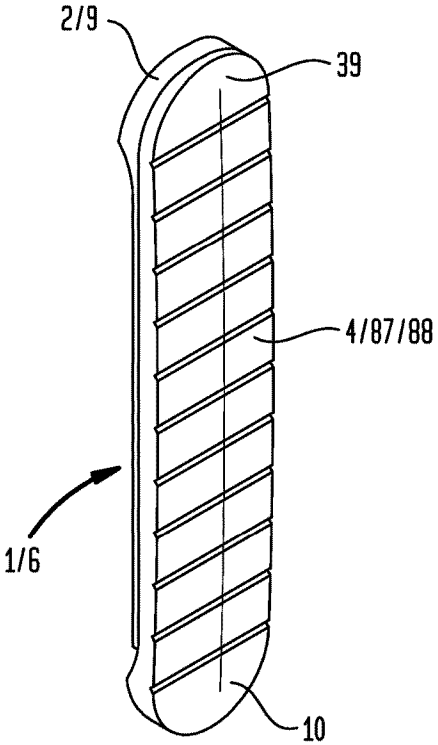
Figure 29:
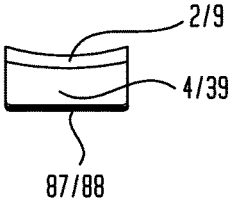
Figure 25:
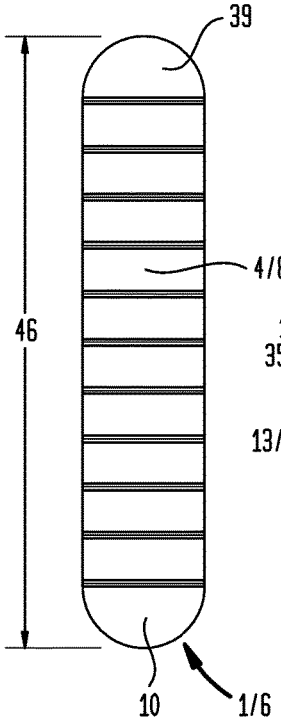
Figure 26:
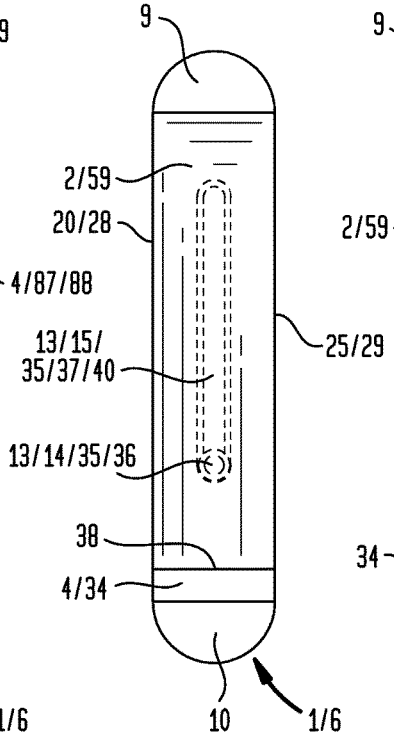
Figure 27:
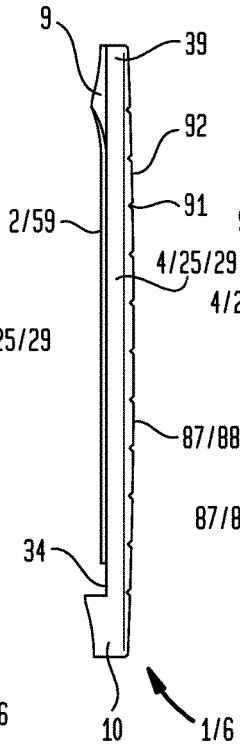
Figure 28:
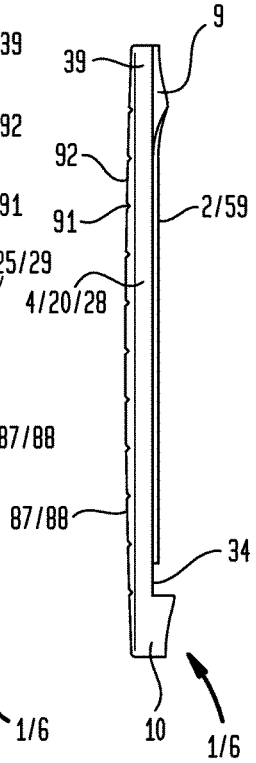
Figure 30:
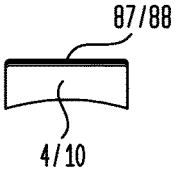
Figure 37:
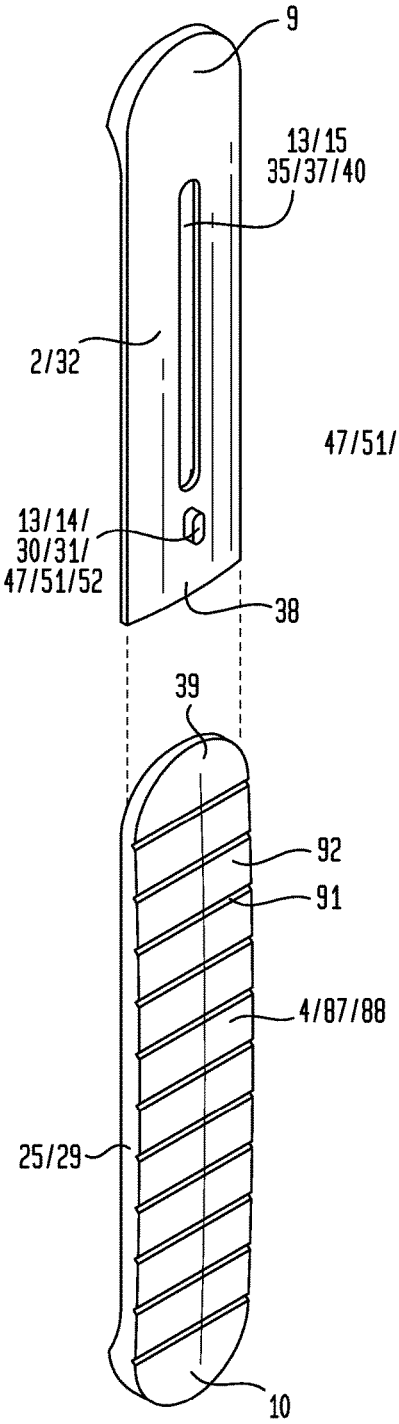
Figure 45B:
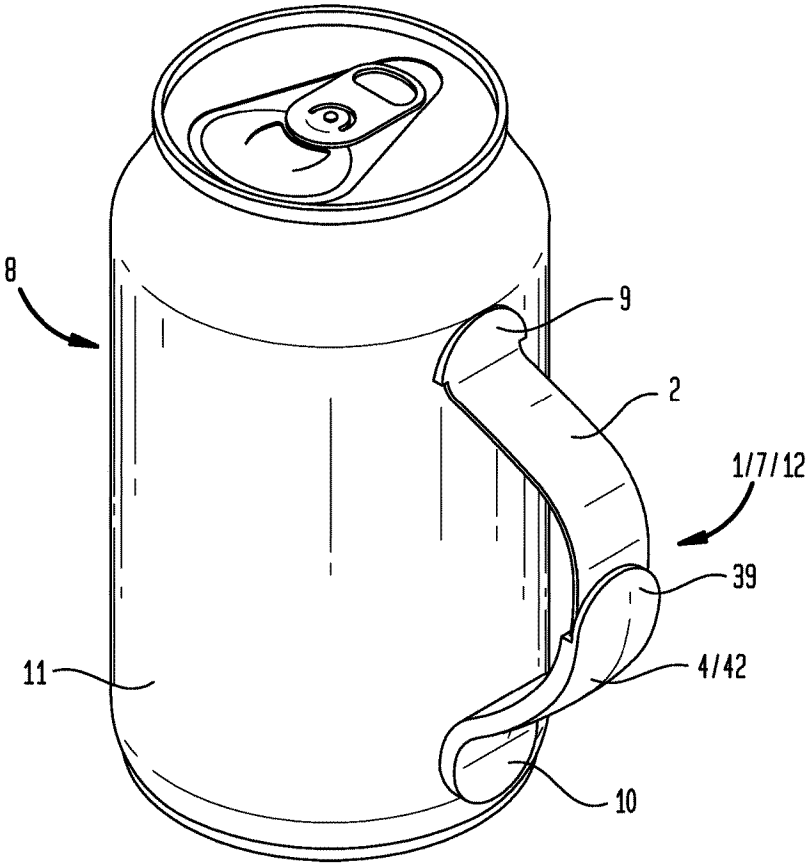
Figure 45A:
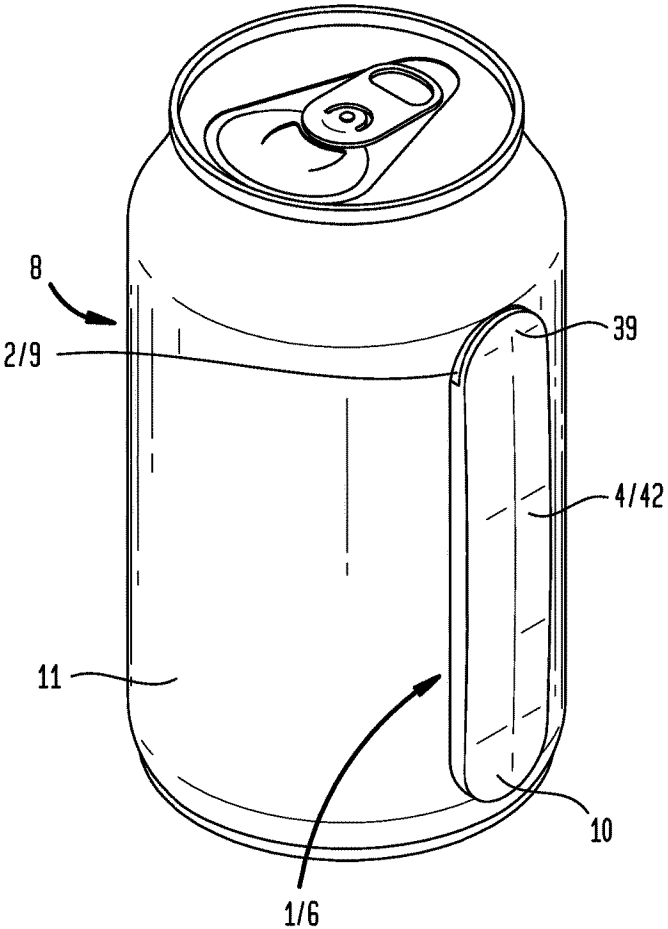
Figure 46C:
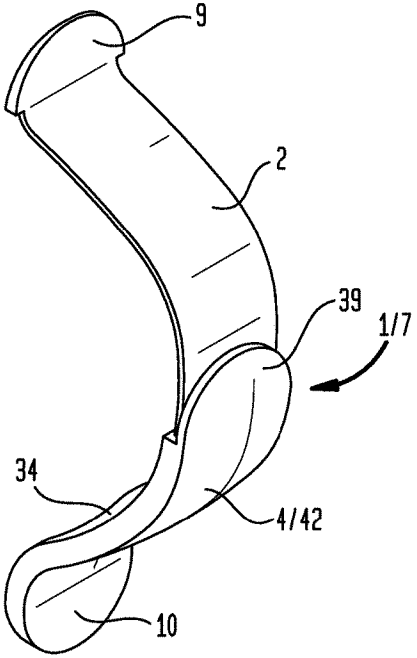
FIG. 46C is a perspective view of a particular embodiment of a handle assembly including a first member and a second member adjustably overlappingly coupled along first and second member lengths by telescoping engagement, whereby the handle assembly disposes in an extended condition.
Figure 46B:
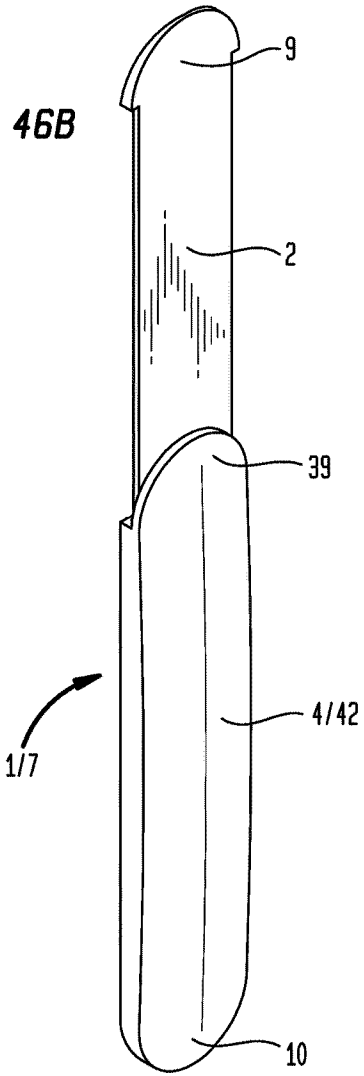
FIG. 46B is a perspective view of a particular embodiment of a handle assembly including a first member and a second member adjustably overlappingly coupled along first and second member lengths by telescoping engagement, whereby the handle assembly disposes in an extended condition.
Figure 46A:
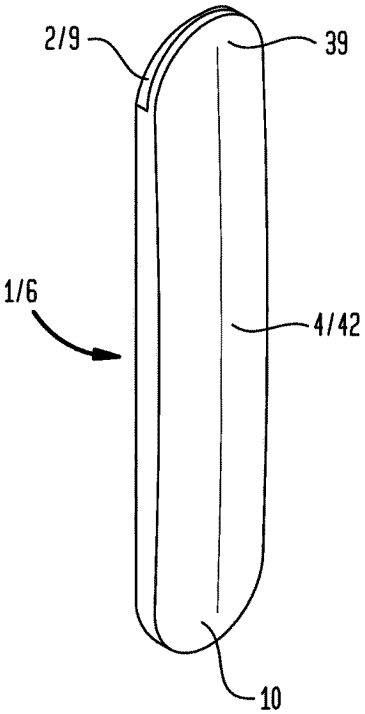
FIG. 46A is a perspective view of a particular embodiment of a handle assembly including a first member and a second member adjustably overlappingly coupled along first and second member lengths by telescoping engagement, whereby the handle assembly disposes in a collapsed condition.
Figure 51:
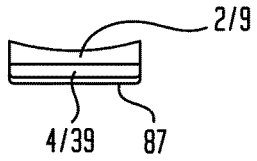
FIG. 51 is a first end view of a particular embodiment of a handle assembly including a first member and a second member adjustably overlappingly coupled along first and second member lengths by telescoping engagement, whereby the handle assembly disposes in a collapsed condition.
Figure 47:
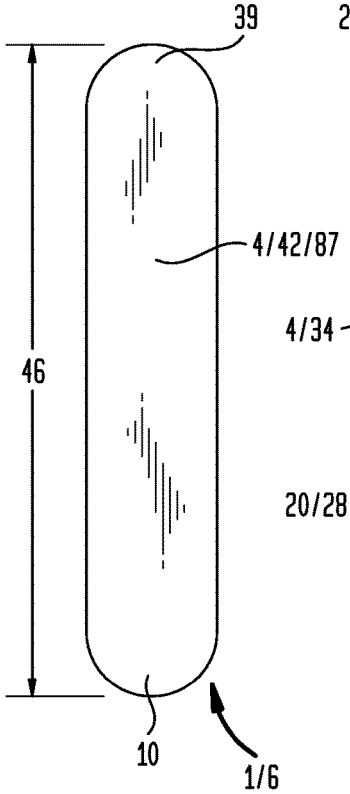
FIG. 47 is a front view of a particular embodiment of a handle assembly including a first member and a second member adjustably overlappingly coupled along first and second member lengths by telescoping engagement, whereby the handle assembly disposes in a collapsed condition.
Figure 48:
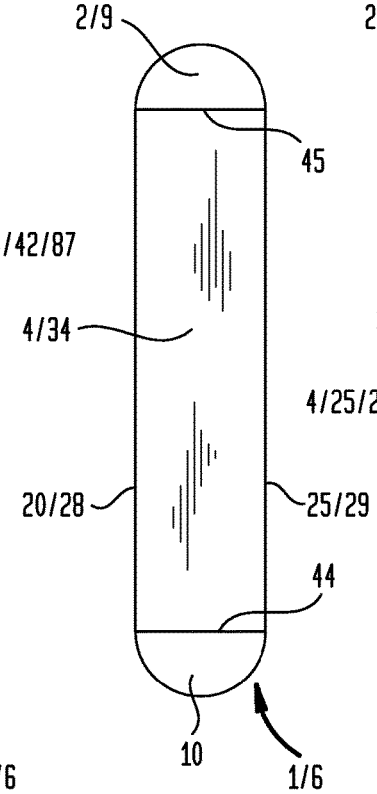
FIG. 48 is a back view of a particular embodiment of a handle assembly including a first member and a second member adjustably overlappingly coupled along first and second member lengths by telescoping engagement, whereby the handle assembly disposes in a collapsed condition.
Figure 49:
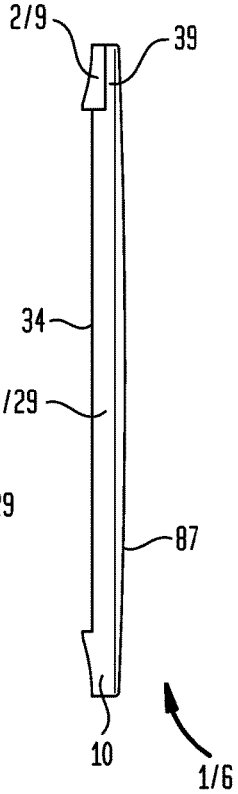
FIG. 49 is a second side view of a particular embodiment of a handle assembly including a first member and a second member adjustably overlappingly coupled along first and second member lengths by telescoping engagement, whereby the handle assembly disposes in a collapsed condition.
Figure 50:
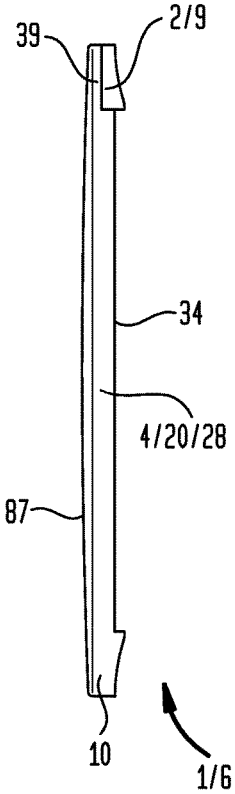
FIG. 50 is a first side view of a particular embodiment of a handle assembly including a first member and a second member adjustably overlappingly coupled along first and second member lengths by telescoping engagement, whereby the handle assembly disposes in a collapsed condition.
Figure 52:
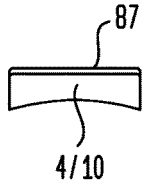
FIG. 52 is a second end view of a particular embodiment of a handle assembly including a first member and a second member adjustably overlappingly coupled along first and second member lengths by telescoping engagement, whereby the handle assembly disposes in a collapsed condition.
Figure 59:
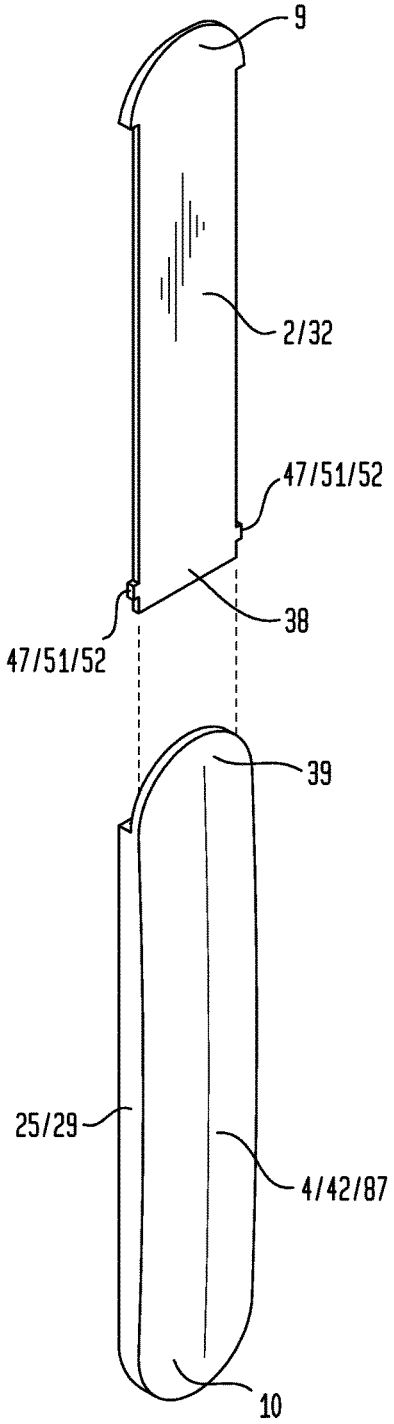
FIG. 59 is an exploded perspective view of a particular embodiment of a handle assembly including a first member and a second member adjustably overlappingly coupled along first and second member lengths by telescoping engagement.

As to particular embodiments, when coupled to a container wall (11), the handle assembly (1) in the collapsed condition (6) can have substantially planar first and second member lengths (3)(5) (as shown in the example of FIG. 1A, FIG. 23A, and FIG. 45A) and, when coupled to a container wall (11), the handle assembly (1) in the extended condition (7) can have arcuate first and second member lengths (3)(5), thereby providing an arcuate grippable element (12) for grippably engaging the container (8) (as shown in the example of FIG. 1B, FIG. 23B, and FIG. 45B).

Figure 67B:
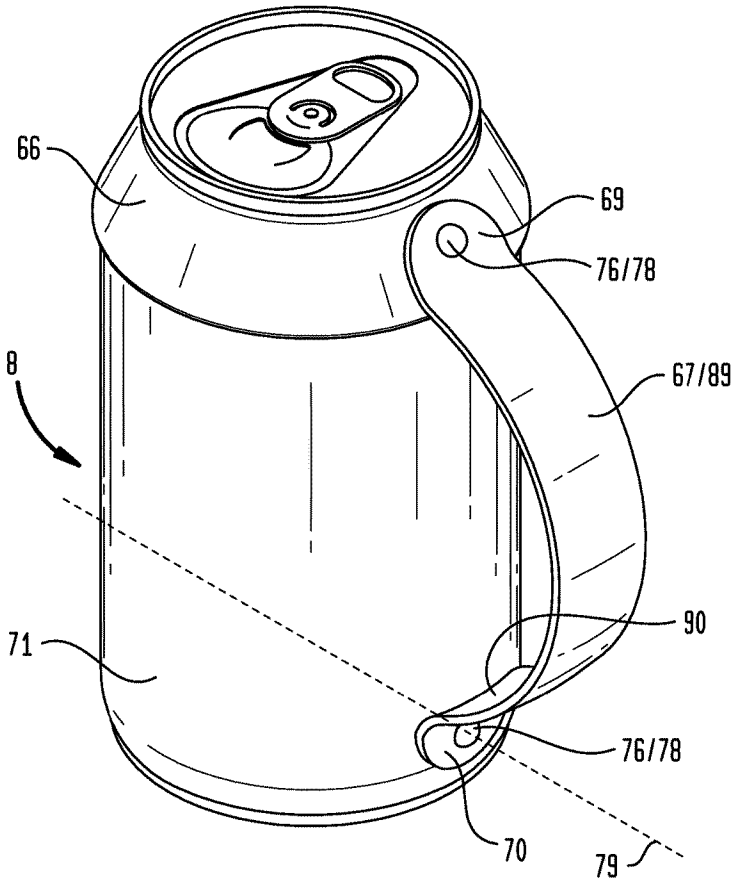
FIG. 67B is an illustration of a method of using a particular embodiment of a handle assembly for grippably engaging a container, the handle assembly including an annular member and an elongate member pivotally coupled to the annular member, whereby the handle assembly disposes in an extended condition to provide a grippable element for grippably engaging the container.
Figure 67A:
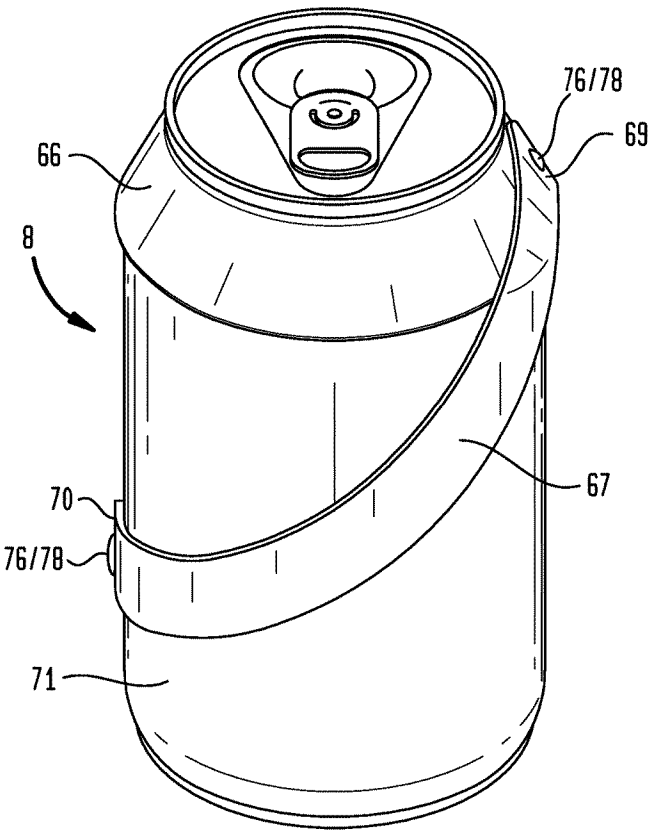
FIG. 67A is an illustration of a method of using a particular embodiment of a handle assembly for grippably engaging a container, the handle assembly including an annular member and an elongate member pivotally coupled to the annular member, whereby the handle assembly disposes in a collapsed condition.
Figure 68B:
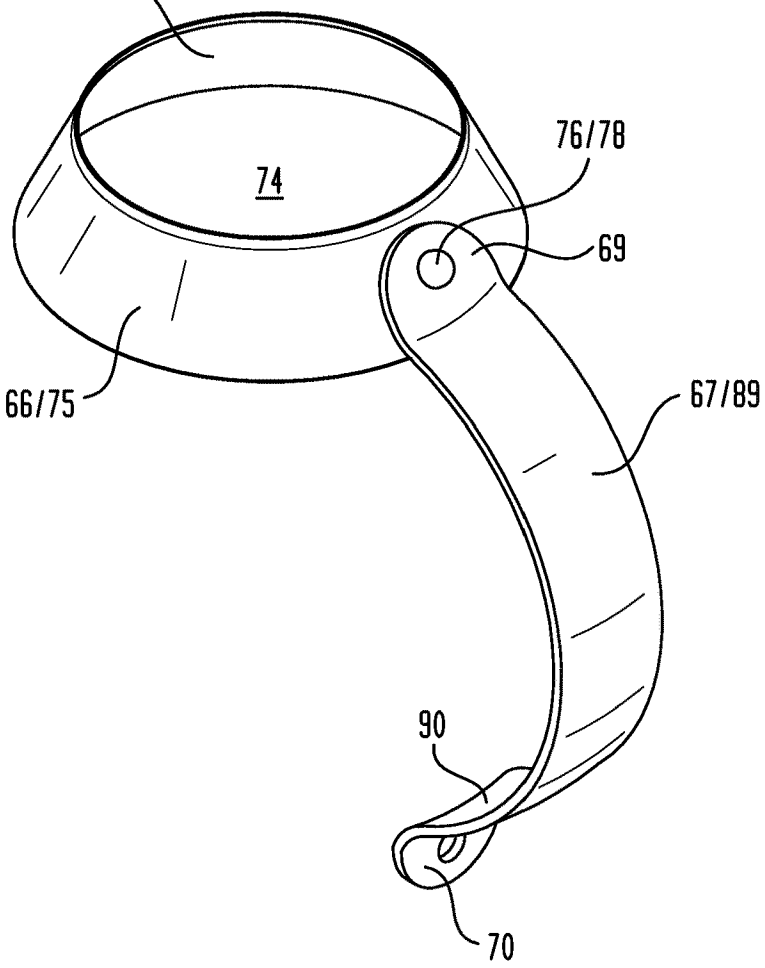
FIG. 68B is a perspective view of a particular embodiment of a handle assembly including an annular member and an elongate member pivotally coupled to the annular member, whereby the handle assembly disposes in an extended condition.
Figure 68A:
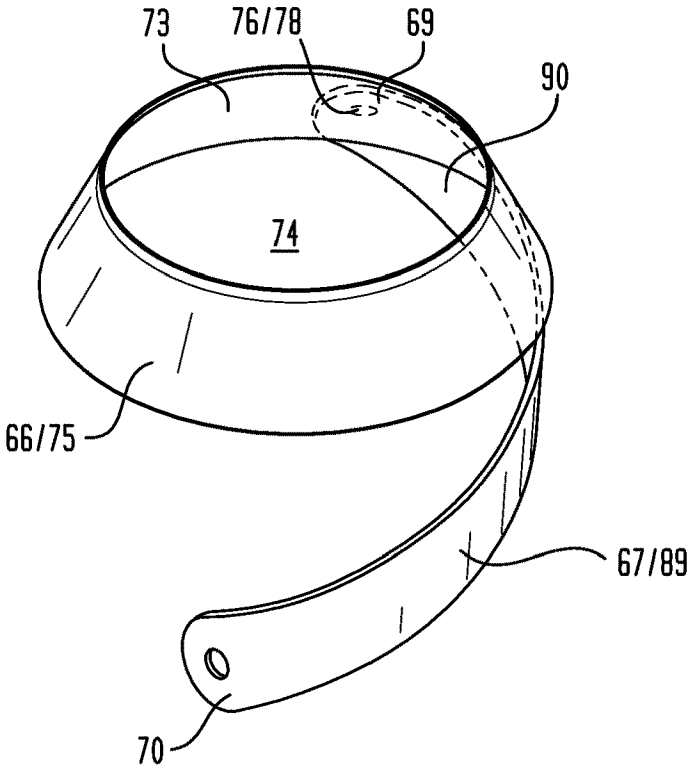
FIG. 68A is a perspective view of a particular embodiment of a handle assembly including an annular member and an elongate member pivotally coupled to the annular member, whereby the handle assembly disposes in a collapsed condition.
Figure 70:
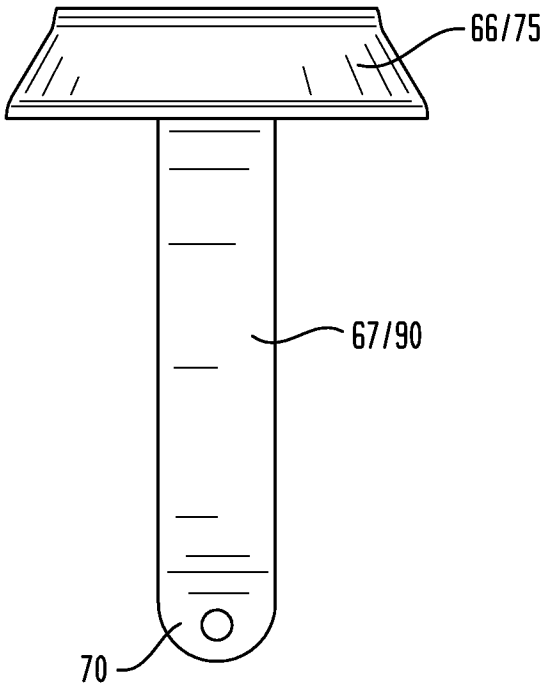
FIG. 70 is a back view of a particular embodiment of a handle assembly including an annular member and an elongate member pivotally coupled to the annular member.
Figure 69:
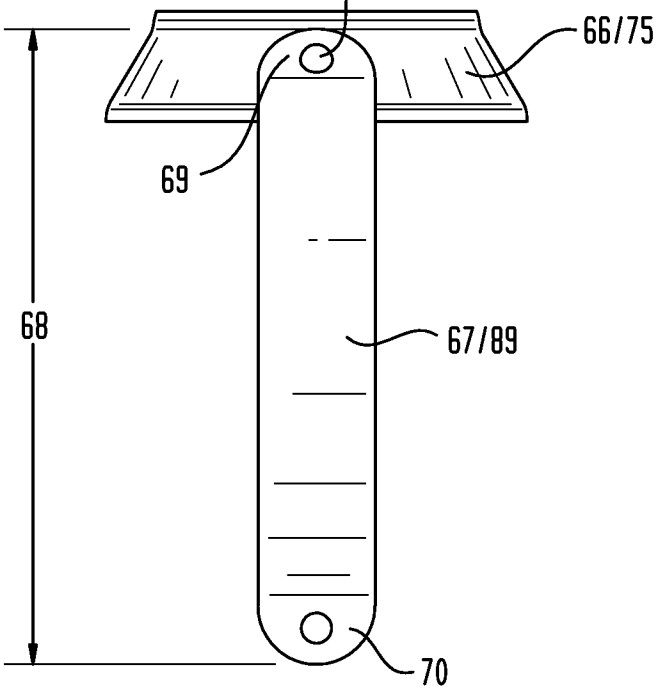
FIG. 69 is a front view of a particular embodiment of a handle assembly including an annular member and an elongate member pivotally coupled to the annular member.
Figure 72:
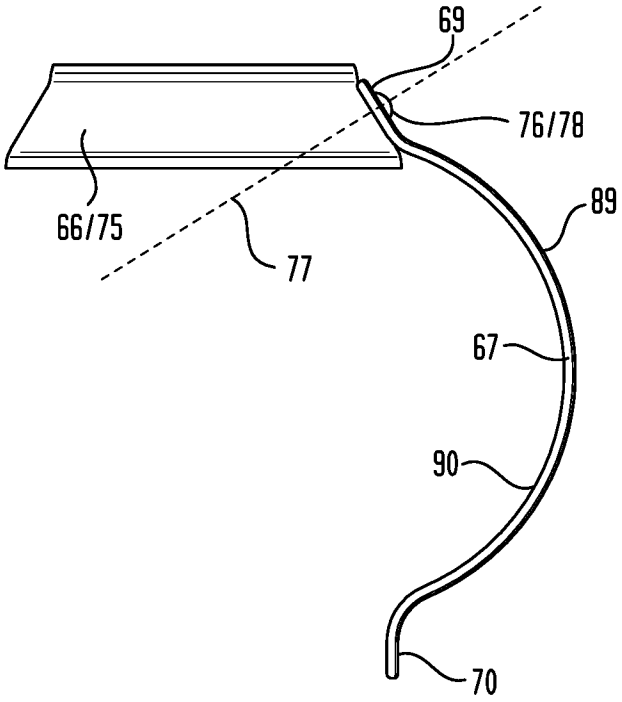
FIG. 72 is a second side view of a particular embodiment of a handle assembly including an annular member and an elongate member pivotally coupled to the annular member.
Figure 71:
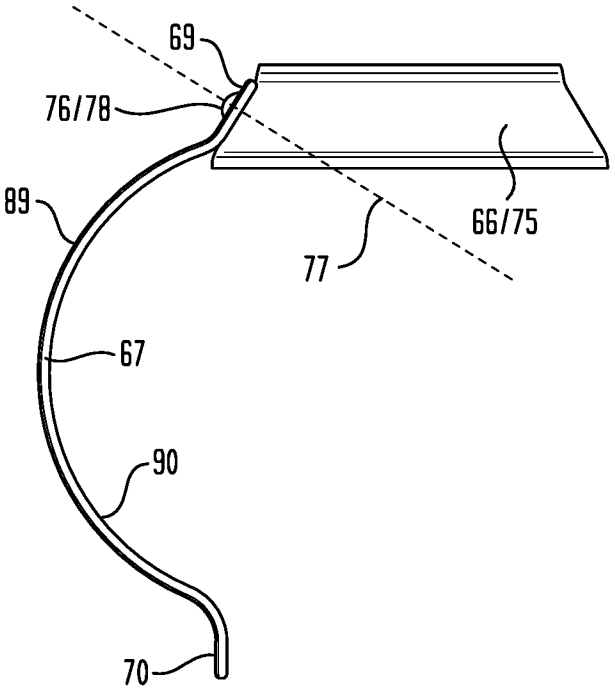
FIG. 71 is a first side view of a particular embodiment of a handle assembly including an annular member and an elongate member pivotally coupled to the annular member.
Figure 73:
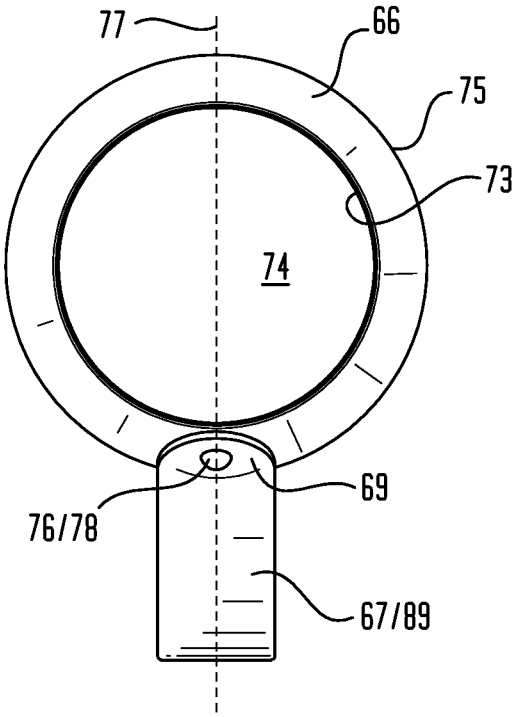
FIG. 73 is a first end view of a particular embodiment of a handle assembly including an annular member and an elongate member pivotally coupled to the annular member.
Figure 74:
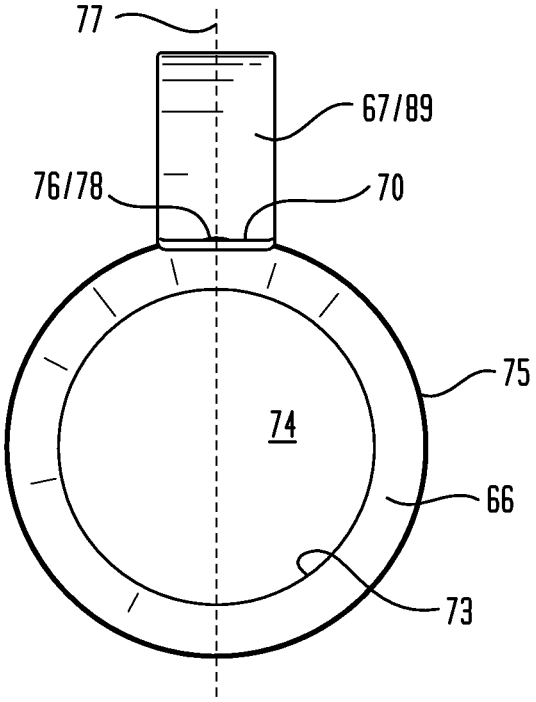
FIG. 74 is a second end view of a particular embodiment of a handle assembly including an annular member and an elongate member pivotally coupled to the annular member.
Figure 75:
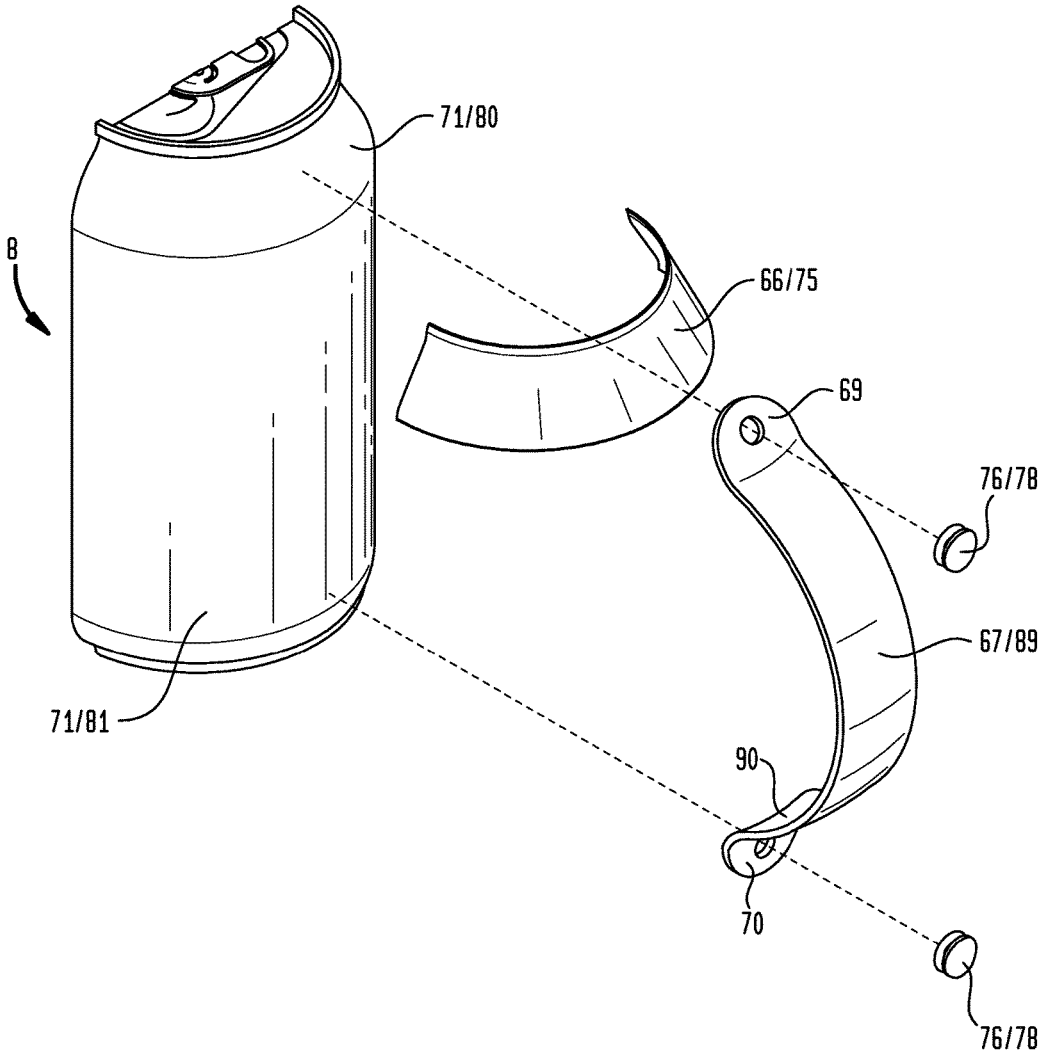
FIG. 75 is an exploded perspective view of a particular embodiment of a handle assembly including an annular member and an elongate member pivotally coupled to the annular member, whereby the handle assembly disposes in an extended condition to provide a grippable element for grippably engaging the container.

Now referring primarily to FIG. 67A and FIG. 67B, which illustrate methods of using a particular embodiment of a handle assembly (1) including an annular member (66) and an elongate member (67) having an elongate member length (68) disposed between elongate member first and second ends (69)(70), whereby the elongate member first end (69) pivotally couples to the annular member (66). The method of using the handle assembly (1) for grippably engaging a container (8), whereby the handle assembly (1) is coupled to the container (8) by rotatable coupling of the annular member (66) about a container external wall (71) and pivotal coupling of the elongate member second end (70) to the container external wall (71), can include adjusting the handle assembly (1) between a collapsed condition (6), whereby the elongate member length (68) disposes proximate the container external wall (71), and an extended condition (7), whereby the elongate member length (68) outwardly extends from the container external wall (71) to provide a grippable element (12) for grippably engaging the container (8).

Again referring primarily to FIG. 67A and FIG. 67B, when the handle assembly (1) is coupled to the container (8), the extended condition (7) is achieved by rotating the annular member (66) to align the elongate member first end (69) with the elongate member second end (70), thereby providing a grippable element (12) for grippably engaging the container (8).

Figures 76A, 76B, 76C:
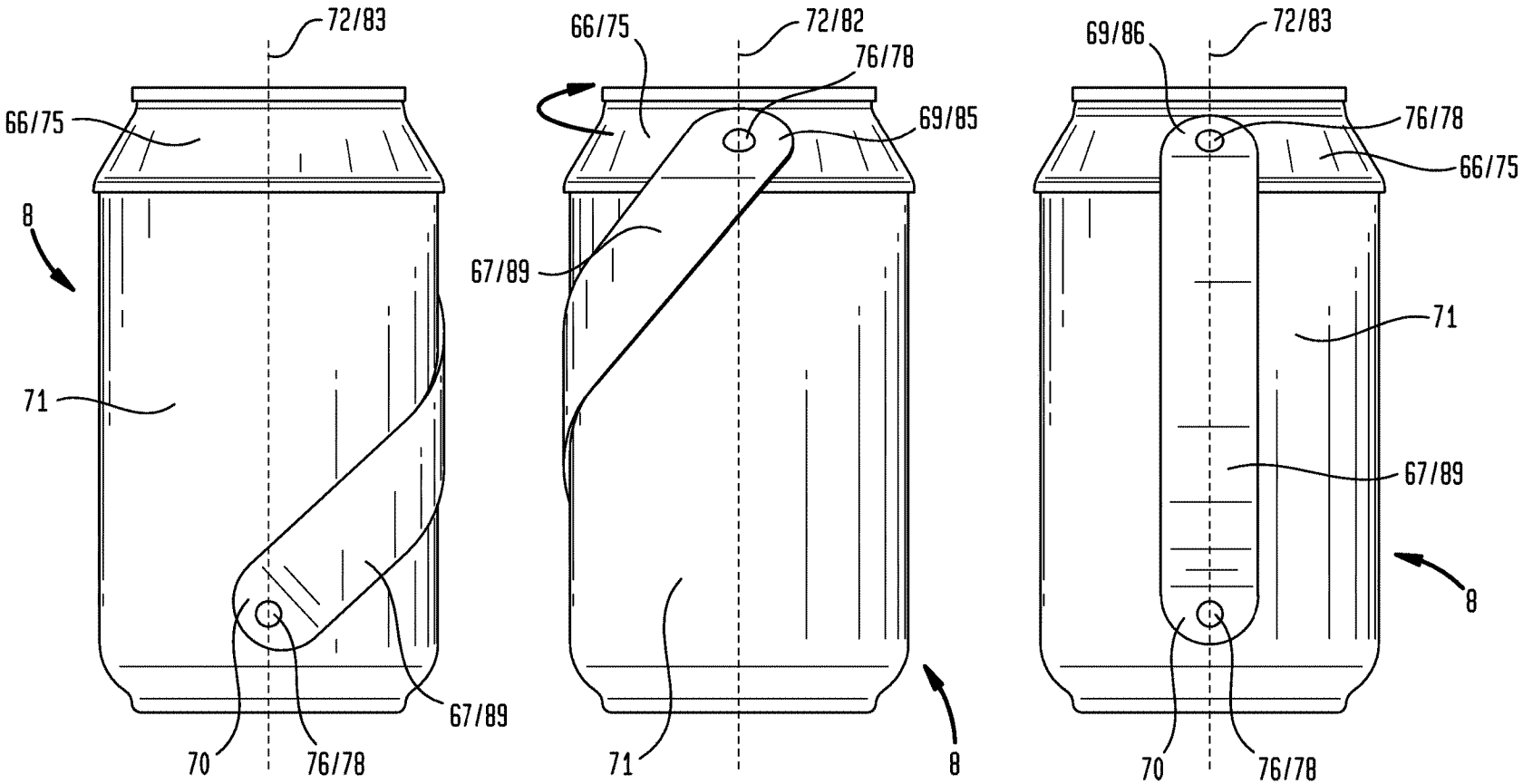
FIG. 76A is a front view of a particular embodiment of a handle assembly including an annular member and an elongate member pivotally coupled to the annular member, whereby the handle assembly disposes in a collapsed condition.
FIG. 76B is a back view of a particular embodiment of a handle assembly including an annular member and an elongate member pivotally coupled to the annular member, whereby the handle assembly disposes in a collapsed condition.
FIG. 76C is a front view of a particular embodiment of a handle assembly including an annular member and an elongate member pivotally coupled to the annular member, whereby the handle assembly disposes in an extended condition to provide a grippable element for grippably engaging the container.

As to particular embodiments, when the handle assembly (1) is coupled to the container (8), the extended condition (7) is achieved by rotating the annular member (66) to align the elongate member first end (69) with the elongate member second end (70) along a container external wall vertical axis (72) (as shown in the example of FIG. 76A through FIG. 76C), thereby providing a grippable element (12) for grippably engaging the container (8).

Now referring primarily to FIG. 67A through FIG. 76C, the handle assembly (1) includes an annular member (66) and an elongate member (67) having an elongate member length (68) disposed between elongate member first and second ends (69)(70), whereby the elongate member first end (69) pivotally couples to the annular member (66).

Now referring primarily to FIG. 68A through FIG. 74, the annular member (66) can have an annular member internal surface (73) which bounds an annular member opening (74), whereby the annular member opening (74) can be configured to receive a container (8). The annular member internal surface (73) can bound an annular member opening (74) having any of a numerous and wide variety of configurations corresponding to the numerous and wide variety of configurations of containers (8) which can be received within the annular member opening (74). For example, the annular member internal surface (73) can bound an annular member opening (74) configured as a circle, an oval, an ellipse, a parabola, a triangle, a square, a rectangle, a trapezoid, a polygon, a freeform shape, or the like, or combinations thereof, whereby the annular member opening (74) which can receive a container (8) having a corresponding circular, oval, elliptical, parabolic, triangular, square, rectangular, trapezoidal, polygonal, or freeform-shaped cross section.

As but one illustrative example, the annular member internal surface (73) can bound a generally circular annular member opening (74), which can receive a generally cylindrical container (8) having a generally circular cross section. Upon receiving the container (8) within the annular member opening (74), the annular member (66) can rotatably couple to the container (8) such that the annular member (66) can rotate about a container external wall (71).

Again referring primarily to FIG. 68A through FIG. 74, the annular member (66) can have an annular member external surface (75) contoured to extend in generally parallel relation to the annular member internal surface (73).

As to particular embodiments, the annular member (66) can further include one or more aperture elements defining aperture element openings which communicate between the annual member internal and external surfaces (73)(75) (not shown).

Again referring primarily to FIG. 68A through FIG. 74, the elongate member (67) has an elongate member length (68) disposed between elongate member first and second ends (69)(70). The elongate member first end (69) pivotally couples to the annular member (66), for example by a pivot element (76) which allows the elongate member first end (69) to pivot about an annular member radial pivot axis (77) passing through the annular member (66). As but one illustrative example, the pivot element (76) can be configured as a rivet (78).

Again referring primarily to FIG. 68A through FIG. 74, the elongate member second end (70) is configured to pivotally couple to the container (8), for example by a pivot element (76) which allows the elongate member second end (70) to pivot about a container radial pivot axis (79) passing through the container (8). As but one illustrative example, the pivot element (76) can be configured as a rivet (78).

Now referring primarily to FIG. 67A, FIG. 67B, and FIG. 76A through FIG. 76C, the handle assembly (1) is configured to couple to the container (8) by rotatable coupling of the annular member (66) about the container external wall (71) and pivotal coupling of the elongate member second end (70) to the container external wall (71). As to particular embodiments, the annular member (66) can rotatably couple about the container external wall (71) proximate a container external wall upper portion (80), thereby disposing the elongate member first end (69) proximate the container external wall upper portion (80), and the elongate member second end (70) can pivotally couple to the container external wall (71) proximate a container external wall lower portion (81).

Again referring primarily to FIG. 67A, FIG. 67B, and FIG. 76A through FIG. 76C, upon coupling to the container (8), the handle assembly (1) can be configured in a collapsed condition (6), whereby generally the entirety of the elongate member length (68) between the elongate member first and second ends (69)(70) can be disposed proximate or adjacent to the container external wall (71). As to particular embodiments, when in the collapsed condition (6), the elongate member first end (69) can dispose along a container external wall first vertical axis (82) and the elongate member second end (70) can dispose along a container external wall second vertical axis (83), whereby the container external wall first and second vertical axes (82)(83) locate a distance apart; as such, the container external wall first and second vertical axes (82)(83) are not vertically collinear. Accordingly, in the collapsed condition (6), the elongate member first and second ends (69)(70) do not vertically align along a container external wall vertical axis (72).

Again referring primarily to FIG. 67A, FIG. 67B, and FIG. 76A through FIG. 76C, as an illustrative example, particular embodiments of the handle assembly (1) which couple to a generally cylindrical container (8) having a generally circular cross section can have the elongate member first end (69) dispose proximate the container external wall upper portion (80) along the container external wall first vertical axis (82) and the elongate member second end (70) dispose proximate the container external wall lower portion (81) along the container external wall second vertical axis (83), whereby the container external wall first and second vertical axes (82)(83) dispose a distance of about 180° apart, consequently disposing the elongate member first and second ends (69)(70) a distance of about 180° apart; however, the invention need not be so limited, as the elongate member first and second ends (69)(70) can dispose a distance of less than about 180° apart or a distance of greater than about 180° apart, depending upon the application, when the handle assembly (1) couples to the generally cylindrical container (8) in the collapsed condition (6).

Again referring primarily to FIG. 67A, FIG. 67B, and FIG. 76A through FIG. 76C, upon coupling to the container (8), the handle assembly (1) can be configured in an extended condition (7), whereby generally the entirety of the elongate member length (68) outwardly extends from the container external wall (71) to provide a grippable element (12) for grippably engaging the container (8). As to particular embodiments, when in the extended condition (7), the elongate member first and second ends (69)(70) can align along the container external wall second vertical axis (83). Accordingly, in the extended condition (7), the elongate member first and second ends (69)(70) vertically align along a container external wall vertical axis (72).

Again referring primarily to FIG. 67A, FIG. 67B, and FIG. 76A through FIG. 76C, the handle assembly (1) coupled to the container (8) can adjust from the collapsed condition (6) toward the extended condition (7) by rotating the annular member (66) such that the elongate member first end (69) rotates from a first location (85) along the container external wall first vertical axis (82) to a second location (86) along the container external wall second vertical axis (83), thus aligning the elongate member first end (69) with the elongate member second end (70) along the container external wall second vertical axis (83).

Again referring primarily to FIG. 67A, FIG. 67B, and FIG. 76A through FIG. 76C, as an illustrative example, particular embodiments of the handle assembly (1) which couple to a generally cylindrical container (8) having a generally circular cross section whereby the elongate member first and second ends (69)(70) dispose a distance of about 180° apart in the collapsed condition (6), can adjust from the collapsed condition (6) toward the extended condition (7) by rotation of the annular member (66) a distance of about 180°. Accordingly, the elongate member first end (69) rotates a distance of about 180° from the first location (85) along the container external wall first vertical axis (82) to the second location (86) along the container external wall second vertical axis (83), thus aligning the elongate member first end (69) with the elongate member second end (70) along the container external wall second vertical axis (83). As such, the elongate member length (68) can outwardly extend from the container external wall (71) to provide a grippable element (12) for grippably engaging the container (8).

A method of making a handle assembly (1) for grippably engaging a container (8) includes providing an annular member (66); providing an elongate member (67) having an elongate member length (68) disposed between elongate member first and second ends (69)(70); and pivotally coupling the elongate member first end (69) to the annular member (66). The handle assembly (1) is configured to couple to the container (8) by rotatable coupling of the annular member (66) about a container external wall (71) and pivotal coupling of the elongate member second end (70) to the container external wall (71). Further, the handle assembly (1) coupled to the container (8) is adjustable between a collapsed condition (6) and an extended condition (7); whereby in the collapsed condition (6), the elongate member length (68) disposes proximate the container external wall (71); and whereby in the extended condition (7), the elongate member length (68) outwardly extends from the container external wall (71) to provide a grippable element (12) for grippably engaging the container (8).

The method of making the handle assembly (1) can further include configuring the annular member (66) to have an annular member internal surface (73) which bounds an annular member opening (74), whereby the annular member opening (74) is configured to receive the container (8).

The method of making the handle assembly (1) can further include configuring the annular member internal surface (73) to bound a generally circular annular member opening (74) configured to receive a container (8) having a generally circular cross section.

The method of making the handle assembly (1) can further include pivotally coupling the elongate member first end (69) to the annular member (66) with a pivot element (76) which allows the elongate member first end (69) to pivot about an annular member radial pivot axis (77) passing through the annular member (66). As to particular embodiments, the method of making the handle assembly (1) can further include configuring the pivot element (76) as a rivet (78).

The method of making the handle assembly (1) can further include configuring the elongate member second end (70) to pivotally couple to the container (8) by a pivot element (76) which allows the elongate member second end (70) to pivot about a container radial pivot axis (79) passing through the container (8). As to particular embodiments, the method of making the handle assembly (1) can further include configuring the pivot element (76) as a rivet (78).

The method of making the handle assembly (1) can further include configuring the handle assembly (1) to couple to the container (8) by: rotatable coupling of the annular member (66) about the container external wall (71) proximate a container external wall upper portion (80) to dispose the elongate member first end (69) proximate the container external wall upper portion (80); and pivotal coupling of the elongate member second end (70) to the container external wall (71) proximate a container external wall lower portion (81).

The method of making the handle assembly (1) can further include configuring the handle assembly (1) such that in the collapsed condition (6), the elongate member first end (69) disposes along a container external wall first vertical axis (82) and the elongate member second end (70) disposes along a container external wall second vertical axis (83); the container external wall first and second vertical axes (82)(83) locate a distance apart such that the container external wall first and second vertical axes (82)(83) are not vertically collinear.

The method of making the handle assembly (1) can further include configuring the handle assembly (1) such that in the collapsed condition (6), the elongate member first and second ends (69)(70) do not vertically align along a container external wall vertical axis (72).

The method of making the handle assembly (1) can further include configuring the handle assembly (1) such that the extended condition (7) is achieved by rotating the annular member (66) to align the elongate member first end (69) with the elongate member second end (70).

The method of making the handle assembly (1) can further include configuring the handle assembly (1) such that the extended condition (7) is achieved by rotating the annular member (66) to align the elongate member first end (69) with the elongate member second end (70) along the container external wall vertical axis (72).

The method of making the handle assembly (1) can further include configuring the handle assembly (1) such that in the extended condition (7), the elongate member first and second ends (69)(70) align along the container external wall second vertical axis (83).

Components of the handle assembly (1), including the first member (2), the second member (4), the annular member (66), or the elongate member (67), can be entirely formed of the same material, or alternatively, components of the handle assembly (1) can be formed from a plurality of materials.

Components of the handle assembly (1) can be formed from any of a numerous and wide variety of materials, including rigid materials, flexible materials, resiliently flexible materials, resiliently deformable materials, or the like, or combinations thereof. By way of non-limiting examples, the material can include or consist of: polymeric materials or resins, for example thermoplastics, such as acrylonitrile butadiene styrene (ABS), acrylic, polyamide, nylon, polybenzimidazole, polyethylene, polypropylene, polystyrene, polyvinyl chloride, polytetrafluoroethylene, or the like, or combinations thereof; thermosets, such as polyester fiberglass, polyurethanes, rubber, polyoxybenzylmethylenglycolanhydride, urea-formaldehyde foam, melamine resin, epoxy resin, polyimides, cynate esters, polycyanurates, polyester, or the like, or combinations thereof; elastomers, such as natural polyisoprene, synthetic polyisoprene, polybutadiene, chloropene rubber, butyl rubber, styrene-butadiene rubber, nitrile rubber, ethylene propylene rubber, epichlorohydrin rubber, polyacrylic rubber, silicone rubber, fluorosilicone rubber, fluoroelastomers, perfluoroelastomers, polyether block amides, chlorosulfonated polyethylene, ethylene-vinyl acetate, thermal plastic elastomer (TPE), or the like, or combinations thereof.

Components of the handle assembly (1) can be made from any of a numerous and wide variety of processes depending upon the application, such as press molding, injection molding, extrusion, fabrication, machining, printing, additive printing, or the like, or combinations thereof, as one piece or assembled from a plurality of pieces into a component of the handle assembly (1).

As to particular embodiments, components of the handle assembly (1) can have a gripping surface (88) configured on a corresponding first member front surface (32), first member back surface (59), second member front surface (87) (as shown in the example of FIG. 23A through FIG. 44E), second member back surface (34), annular member external surface (75), annular member internal surface (73), elongate member front surface (89), or elongate member back surface (90). As an illustrative example, the gripping surface (88) can include one or more recess elements (91) disposed in spaced apart relation within the gripping surface (88) or one or more or more raised elements (92) outwardly extending in spaced apart relation from the gripping surface (88), or the like, or combinations thereof.

As to particular embodiments, components of the handle assembly (1), including the first member (2), the second member (4), or the elongate member (67), can have a hinge element, such as a living hinge, incorporated therewithin (not shown), whereby the hinge element facilitates adjustment between the collapsed and extended condition (6)(7).

A method of using a handle assembly (1) for grippably engaging a container (8) includes obtaining the handle assembly (1) comprising an annular member (66) and an elongate member (67) having an elongate member length (68) disposed between elongate member first and second ends (69)(70), whereby the elongate member first end (69) pivotally couples to the annular member (66). The method of using the handle assembly (1) for grippably engaging the container (8), whereby the handle assembly (1) is coupled to the container (8) by rotatable coupling of the annular member (66) about a container external wall (71) and pivotal coupling of the elongate member second end (70) to the container external wall (71), can include adjusting the handle assembly (1) coupled to the container (8) between a collapsed condition (6), whereby the elongate member length (68) disposes proximate the container external wall (71), and an extended condition (7), whereby the elongate member length (68) outwardly extends from the container external wall (71), thereby providing a grippable element (12) for grippably engaging the container (8).

As to particular embodiments, the handle assembly (1) is coupled to the container (8) by: rotatable coupling of the annular member (66) about the container external wall (71) proximate a container external wall upper portion (80) to dispose the elongate member first end (69) proximate the container external wall upper portion (80); and pivotal coupling of the elongate member second end (70) to the container external wall (71) proximate a container external wall lower portion (81).

As to particular embodiments, when the handle assembly (1) is in the collapsed condition (6), the elongate member first end (69) disposes along a container external wall first vertical axis (82) and the elongate member second end (70) disposes along a container external wall second vertical axis (83); the container external wall first and second vertical axes (82)(83) locate a distance apart such that the container external wall first and second vertical axes (82)(83) are not vertically collinear.

As to particular embodiments, when the handle assembly (1) is in the collapsed condition (6), the elongate member first and second ends (69)(70) do not vertically align along a container external wall vertical axis (72).

The method of using the handle assembly (1) can further include achieving the extended condition (7) by rotating the annular member (66) to align the elongate member first end (69) with the elongate member second end (70).

The method of using the handle assembly (1) can further include achieving the extended condition (7) by rotating the annular member (66) to align the elongate member first end (69) with the elongate member second end (70) along the container external wall vertical axis (72).

The method of using the handle assembly (1) can further include achieving the extended condition (7) by vertically aligning the elongate member first and second ends (69)(70) along the container external wall second vertical axis (83).

The method of using the handle assembly (1) can further include gripping the grippable element (12) to grippably engage the container (8).

As can be easily understood from the foregoing, the basic concepts of the present invention may be embodied in a variety of ways. The invention involves numerous and varied embodiments of a handle assembly and methods for making and using such handle assemblies, including the best mode.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "coupler" should be understood to encompass disclosure of the act of "coupling"—whether explicitly discussed or not—and, conversely, were there effectively disclosure of the act of "coupling", such a disclosure should be understood to encompass disclosure of a "coupler" and even a "means for coupling." Such alternative terms for each element or step are to be understood to be explicitly included in the description.

In addition, as to each term used it should be understood that unless its utilization in this application is inconsistent with such interpretation, common dictionary definitions should be understood to included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a person of ordinary skill in the art would consider as having the same function or result. When a particular element is expressed as an approximation by use of the antecedent "substantially," it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Thus, the applicant(s) should be understood to claim at least: i) each of the handle assemblies herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application, if any, provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

Additionally, the claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

The invention claimed is:

1. A handle assembly for grippably engaging a container, said handle assembly comprising:

an annular member;

an elongate member having an elongate member length disposed between elongate member first and second ends; and a first pivot element which passes through said elongate member first end from an elongate member back surface to an elongate member front surface to pivotally couple said elongate member first end to said annular member;

wherein said handle assembly is configured to couple to said container by rotatable coupling of said annular member about a container external wall and pivotal coupling of said elongate member second end to said container external wall;

wherein said handle assembly coupled to said container is adjustable between a collapsed condition and an extended condition;

wherein in said collapsed condition, said elongate member back surface disposes proximate and faces said container external wall;

wherein in said extended condition, said elongate member length outwardly extends from said container external wall to provide a grippable element for grippably engaging said container.

2. The handle assembly of claim 1, wherein said annular member has an annular member internal surface which bounds an annular member opening;

wherein said annular member opening is configured to receive said container.

3. The handle assembly of claim 2, wherein said annular member internal surface bounds a generally circular annular member opening configured to receive said container having a generally circular cross section.

4. The handle assembly of claim 1, further comprising a second pivot element which passes through said elongate member second end to pivotally couple said elongate member second end to said container.

5. The handle assembly of claim 1, wherein said handle assembly is configured to couple to said container by:

rotatable coupling of said annular member about said container external wall proximate a container external wall upper portion to dispose said elongate member first end proximate said container external wall upper portion; and pivotal coupling of said elongate member second end to said container external wall proximate a container external wall lower portion.

6. The handle assembly of claim 1, wherein in said collapsed condition, said elongate member first end disposes along a container external wall first vertical axis and said elongate member second end disposes along a container external wall second vertical axis; said container external wall first and second vertical axes locate a distance apart such that said container external wall first and second vertical axes are not vertically collinear.

7. The handle assembly of claim 6, wherein in said collapsed condition, said elongate member first and second ends do not vertically align along a container external wall vertical axis.

8. The handle assembly of claim 7, wherein said extended condition is achieved by rotating said annular member to align said elongate member first end with said elongate member second end.

9. The handle assembly of claim 8, wherein said extended condition is achieved by rotating said annular member to align said elongate member first end with said elongate member second end along said container external wall vertical axis.

10. The handle assembly of claim 9, wherein in said extended condition, said elongate member first and second ends align along said container external wall second vertical axis.

* * * * *